United States Patent [19]

Fleming et al.

[11] 4,284,704

[45] * Aug. 18, 1981

[54] PHOTOGRAPHIC ELEMENTS WITH INCORPORATED HYDROGEN SOURCE PHOTOREDUCTANT AND TETRAZOLIUM SALT

[75] Inventors: James C. Fleming; Joseph W. Manthey; Ralph T. Brongo, all of Rochester, N.Y.

[73] Assignee: Eastman Kodak Company, Rochester, N.Y.

[ * ] Notice: The portion of the term of this patent subsequent to Aug. 18, 1998, has been disclaimed.

[21] Appl. No.: 947,306

[22] Filed: Sep. 29, 1978

Related U.S. Application Data

[63] Continuation-in-part of Ser. No. 714,434, Aug. 13, 1976, abandoned, which is a continuation-in-part of Ser. No. 509,616, Sep. 26, 1974, abandoned, which is a continuation-in-part of Ser. No. 384,861, Aug. 2, 1973, abandoned.

[51] Int. Cl.[3] ..... G03C 1/727; G03C 1/60

[52] U.S. Cl. ..... 430/154; 430/147; 430/155; 430/170; 430/332; 430/340; 430/342; 430/343; 430/344; 430/367; 430/374; 430/541; 430/151; 430/171; 430/190; 430/293; 430/302; 430/350; 430/351; 430/495; 430/617; 430/618; 430/936

[58] Field of Search ..... 96/90 R, 88; 430/147, 430/170, 332, 340, 342, 343, 344, 374, 541, 367, 154, 155

[56] References Cited

U.S. PATENT DOCUMENTS

| | | | |
|---|---|---|---|
| 2,322,982 | 6/1943 | Von Poser | 96/90 R |
| 3,278,366 | 10/1966 | Schiele | 161/227 |
| 3,287,129 | 11/1966 | Rees et al. | 96/66 R |
| 3,383,212 | 5/1968 | MacLachlan | 96/90 R |
| 3,390,994 | 7/1968 | Cescon | 96/90 R |
| 3,390,996 | 7/1968 | MacLachlan | 96/90 R |
| 3,409,438 | 11/1968 | Lakkan | 96/95 |
| 3,529,963 | 9/1970 | Marchese | 96/114.1 |
| 3,642,478 | 2/1972 | Brault et al. | 96/60 BF |
| 3,655,382 | 4/1972 | Brault et al. | 96/4 |
| 3,671,244 | 6/1972 | Bissonetti | 96/84 |
| 3,880,659 | 4/1975 | Bailey et al. | 96/90 R |
| 3,887,372 | 6/1975 | Bailey | 96/90 R |
| 3,887,374 | 6/1975 | Brongo et al. | 96/90 R |
| 3,917,484 | 11/1975 | Bailey | 96/88 |

FOREIGN PATENT DOCUMENTS

| | | | |
|---|---|---|---|
| 670883 | 4/1952 | United Kingdom | 96/90 R |
| 908299 | 10/1962 | United Kingdom | 96/66 R |
| 1016822 | 1/1966 | United Kingdom | 161/227 |

OTHER PUBLICATIONS

Research Disclosure, vol. 126, Publication No. 12617, Oct. 1974.

*Primary Examiner*—Charles L. Bowers, Jr.
*Attorney, Agent, or Firm*—Dana M. Schmidt

[57] ABSTRACT

Imaging means, such as a tetrazolium salt, capable of reduction to form a visible image is present in a radiation-sensitive layer in combination with a photoreductant incorporating one or more labile hydrogen atoms and capable of producing a reducing agent precursor in radiation-struck areas of the layer. An image is produced in the layer by processing the layer after imagewise exposure to actinic radiation.

17 Claims, No Drawings

PHOTOGRAPHIC ELEMENTS WITH INCORPORATED HYDROGEN SOURCE PHOTOREDUCTANT AND TETRAZOLIUM SALT

RELATED APPLICATIONS

This application is a continuation-in-part application of U.S. Ser. No. 714,434 filed on Aug. 13, 1976, now abandoned, which in turn is a continuation-in-part of U.S. Ser. No. 509,616 filed on Sept. 26, 1974, now abandoned. U.S. Ser. No. 509,616 is a continuation-in-part of U.S. Ser. No. 384,861 filed on Aug. 2, 1973, now abandoned.

BACKGROUND OF THE INVENTION

This invention relates to an improved photographic element which exhibits improved light sensitivity and speed and to a process for recording images therewith. In a specific aspect, this invention is directed to an improved photographic element and to a process for its use in which a visible image is selectively produced by the interaction of an improved photoreductant with a dye precursor in image areas, while the background areas remain stable and of low optical density in the presence of actinic radiation and without removal or alteration of the dye precursor.

It is well known in the photographic arts to record images by incorporating within a radiation-sensitive layer of a photographic element a dye precursor of low optical density capable of conversion to a visible dye. In order to avoid dye printout in background areas after exposure it is conventional practice to inactivate and/or wash out the dye precursor. Where the dye is formed by oxidation of its precursor there is frequently a problem with background printout attributable to atmospheric oxidation of the dye precursor remaining in the background areas. The loss of contrast is, of course, further accelerated if the dye itself also tends to fade.

The reduction of a tetrazolium salt to form a formazan dye image is generally well known in the art. For example, in Brault et al U.S. Pat. No. 3,642,478, issued Feb. 15, 1972; Brault et al U.S. Pat. No. 3,655,382, issued Apr. 11, 1972 and Bissonette et al U.S. Pat. No. 3,671,244, issued June 20, 1972, there are disclosed processes for utilizing a zero valent metal image to reduce a tetrazolium salt and produce a formazan dye image.

A system that does not require the presence of a metal image is disclosed by Jaeken et al in British Pat. No. 670,883 published Apr. 30, 1952. Jaeken et al incorporates into a photographic element a tetrazolium salt and a reducing agent precursor which on exposure to light produce a formazan dye image. After exposure the photographic element is washed in up to three successive aqueous baths intended to fix the image by removal of the unreduced tetrazolium salt remaining in the background areas, enhance the image density and remove the remaining reducing agent precursor and the reaction products which, if left in place, would stain the background of the photographic element. Reducing agent precursors such as ferric salts, vanadic compounds, tungstic compounds and uranium salts are employed. Baths containing organic hydroxy acids or their ammonium salts are used to remove the brown oxides produced by ferric salts. Aqueous ammonia solutions are optionally used for image enhancement while water or dilute acid fixing baths are used to remove residual tetrazolium salts.

As improvements on the teachings of Jaeken et al, Telefunken British Pat. No . 1,016,822, published Jan. 12, 1966, and Schiele U.S. Pat. No. 3,278,366, issued Oct. 11, 1966, teach the reduction of a tetrazolium salt to a formazan dye in response to radiation of 200 nm or less. In contrast to the system of Jaeken et al in which the reducing agent precursor is acted on by radiation to produce a reducing agent, Telefunken and Schiele activate the tetrazolium salt by radiation to cause it to react with the available reducing agent. For very high-energy radiation below 200 nm, no separate reducing agent is required to convert the tetrazolium salt to a formazan dye. The exposed photographic elements of Schiele and Telefunken can be viewed without fixing since they are insensitive to radiation within the visible spectrum. Of course, re-exposure to actinic radiation would result in background printout.

Other imaging systems have produced a silver image by photoinitiating a reduction of silver halide or silver salt to the silver. The reductant, or progenitor of the reductant has been in some cases a quinone. However, the specific quinones of those systems were not easily photoconverted, due to the lack of internal hydrogen sources as defined hereafter. The unpredictability of the effectiveness of structurally related compounds is also a recognized feature of these prior systems. Examples of individual quinones for such systems are disclosed in U.S. Pat. Nos. 3,287,129; 3,409,438; and 3,529,963. U.S. Pat. No. 3,287,129, while suggesting a broad class of quinones including those having an amino group attached to the naphthoquinone ring, does not recognize the superiority specifically available with internal hydrogen source quinones. Thus, the examples set forth in detail all lack internal hydrogen sources.

Still other imaging systems have incorporated quinones, some of which are internal hydrogen sources, to reduce portions of the imaging systems. However, these have been limited to the use of the quinones as photoreductants for the sole purpose of deactivating the imaging system to prevent printout. Examples are disclosed in U.S. Pat. No. 2,322,982, wherein the imaging means are diazonium salts and couplers, and U.S. Pat. Nos. 3,383,212; 3,390,994; and 3,390,996 wherein the quinone is converted to a reducing agent to deactivate a photooxidant in a leuco dye system.

SUMMARY OF THE INVENTION

It is an object of this invention to provide photographic elements that are responsive to radiation within the ultraviolet and visible spectrum, that can be used with, but do not necessarily require the incorporation of, metals or metal salts, and that can be processed in a dry state, and that do not require the incorporation of a source of labile hydrogen atoms in addition to the photoreductant.

It is a more specific object of this invention to provide such photographic elements which require fewer components.

It is a further object to provide such photographic elements that exhibit enhanced speed and image density.

It is another object to provide a process for using such photographic elements which requires only image exposure followed by a single processing step which can be performed in a dry state.

It is an additional object to provide such a process that requires fewer components and can form images with greater speed and/or density.

In one aspect, these objects are achieved by the provision in an imaging element having a support and at least one radiation-sensitive image recording layer, the improvement in which the image recording layer is comprised of an internal hydrogen source quinone capable of producing a reducing agent on exposure to activating radiation, and an image recording means for generating an image upon reduction by the reducing agent produced by the exposed quinone.

In another aspect, this invention is directed to a photographic element having a support and at least one radiation-sensitive image recording layer comprised of a tetrazolium salt capable of reduction to a formazan dye and a photoreductant incorporating one or more labile hydrogen atoms capable of producing a base activatible reducing agent precursor on exposure to actinic radiation.

In still another aspect this invention is directed to an image recording process comprising converting a photoreductant incorporating at least one labile hydrogen atom within a selected areal portion of a radiation-sensitive layer of a photographic element to form a reducing agent precursor. Conversion of the photoreductant to the reducing agent precursor is accomplished by imagewise exposing the photoreductant to actinic radiation. Thereafter the precursor is activated to form a reducing agent and reduces the imaging means present within the selected areal portions containing the reducing agent to form a dye or image precursor or to bleach a dye.

DESCRIPTION OF THE PREFERRED EMBODIMENTS

The invention concerns the discovery that certain photoreductants, and particularly internal hydrogen source quinones, when combined with image recording means will produce, directly or indirectly through development and integrally or externally of the initial element, the desired image. By "image recording means", it is meant a substance which itself produces an image or does so upon contact with another material provided either integrally and intimately mixed with the image recording means or provided in a separate adjacent layer. Thus, in varied aspects of the invention the image recording means can be a transition metal complex capable of releasing ligands upon reduction, such as a cobalt(III)complex which upon reduction forms Co(II) and releases ligands, either of which can initiate with other compounds the formation of a dye image or the deletion of a dye image. In another form, the image recording means can be a reducible metal salt such as the silver salt of an organic acid. Alternative embodiments also include triazolium salts which reduce to azo-amine dyes, bleachable dyes which bleach out when reduced by the photolysis product of the exposed photoreductant, and leuco phthalocyanine dyes which reduce to a dye.

Preferably, the photoreductant is present in the imaging element in an amount of from about 0.1 to about 10 moles per mole of the image recording means, and the recording means in turn is present in the element in an amount of at least about $1\times10^{-7}$ moles per square decimeter of surface of the imaging element.

In a specifically preferred embodiment of the invention a tetrazolium salt capable of reduction to form a formazan dye and a photoreductant incorporating one or more labile hydrogen atoms are associated within a binder and coated onto a conventional photographic support to form a radiation-sensitive image recording layer. The resulting photographic element is then exposed imagewise to actinic radiation. Actinic radiation in this case is radiation in the ultraviolet and/or visible spectrum—that is, electromagnetic radiation of less than 700 nm in wavelength and, preferably, below 500 nm. Exposure causes the photoreductant to form a latent image in the radiation-struck areas of the image recording layer. In latent image formation the photoreductant is converted to a reducing agent precursor which, in turn, can be readily converted to a reducing agent in the presence of a base.

While Applicants do not wish to be bound by any particular theory as to how the photoreductant forms the latent image, it is believed that one or more of the labile hydrogen atoms present within the photoreductant molecule rearrange themselves on exposure of the photoreductant to actinic radiation to produce the reducing agent precursor. As formed, the reducing agent precursor generated by the radiation-struck photoreductant is incapable of directly reducing the imaging means. However, when the exposed radiation-sensitive layer is subsequently treated, such as with a base, preferably gaseous ammonia, the reducing agent precursor is converted to an active reducing agent which reacts with the imaging means such as tetrazolium salt to form a formazan dye.

It is a specific advantage of certain embodiments of the invention that the exposed image-bearing photographic elements of this invention can be re-exposed to actinic radiation without fixing. The reason for this is that, while the remaining photoreductant will form a second latent image in the background areas when the photographic element is re-exposed, this does not interfere with seeing the existing visible image. The photoreductant is specifically chosen to yield a reducing agent precursor that is light in color and, preferably, substantially colorless, so that a sharp visible contrast exists between the dye image and the background areas.

It is another distinct advantage of the preferred embodiments of this invention requiring a base for development that they exhibit stable, low density backgrounds when stored in the atmosphere over extended periods. Since the atmosphere is free of basic substances, the reducing agent precursor is not converted to a reducing agent during storage of the photographic element in contact with the atmosphere. Similarly, there is no direct atmospheric reduction of the tetrazolium salt on storage of the photographic elements. Over an extended period of time atmospheric oxygen can oxidize the latent image of the reducing agent precursor, thereby entirely eliminating the possibility of unwanted image formation. Thus, in marked contrast to photographic elements that contain dye precursors which form visible dyes on oxidation, the photographic elements of the present invention are notably free of background printout.

Whereas in classical photography a succession of developing, stopping, fixing and rinsing baths are typically used in the course of forming a stable photographic record, it is a significant feature of this invention that wet processing of the photographic element is not necessarily required. While it is recognized that the reducing agent precursor could, if desired, be brought into contact with a basic solution for activation as a reducing agent, where activation is by a base, a preferred practice of this invention provides that the reducing agent precursor is contacted with gaseous ammonia to produce the active reducing agent. In one form the gaseous ammonia can be generated "in situ". Beyond this, in the image recording layer each of the components and each of the reaction products formed, except for the formazan dye, are of low optical density. This avoids any need for rinsing or processing baths to remove or alter any of the components or reaction products formed within the image-recording layer.

Since the single processing step of exposure to gaseous ammonia can be performed in commercially available equipment sold for this purpose and since no resort to comparatively cumbersome conventional photographic processing techniques, such as processing baths, uniform or image area heating, volatilizing components and the like, is required, it is apparent that the photographic elements of the present invention are advantageously simple and convenient to use.

The triazolium salts, when used as the image recording means, achieve advantages similar to those outlined in the preceding paragraphs.

When the image recording means is a metallic ion complex as described below, further advantages which are achieved are centered about the fact that development with a base can be disposed of entirely. Thermal development is all that is necessary, and then only in instances in which the redox reaction with the reducing agent resulting from the exposure of the photoreductant is slow enough to make such application of heat desirable. In many instances the redox couple is sufficiently reactive as to not even require this development step.

PHOTOREDUCTANT

As employed herein, the term "photoreductant" designates a material capable of molecular photolysis or photo-induced rearrangement to generate a reducing agent directly or indirectly through the generation of a reducing agent precursor which is not a reducing agent, but which can be activated by means such as heat or a base to become a reducing agent.

The photoreductants employed in the practice of this invention incorporate one or more labile hydrogen atoms which facilitate their conversion to reducing agent precursors or reducing agents. Such photoreductants are herein referred to as "internal hydrogen source photoreductants". A preferred class of internal hydrogen source photoreductants are quinones incorporating one or more labile hydrogen atoms, herein referred to as "internal hydrogen source quinones". Internal hydrogen source photoreductants and, more specifically, internal hydrogen source quinones, should be distinguished from "external hydrogen source photoreductants"—that is, photoreductants requiring an external source of labile hydrogen atoms to be present for the photoreductant to be efficiently converted to a reducing agent precursor or reducing agent. External hydrogen source photoreductants are disclosed in our commonly assigned, copending U.S. application Ser. No. 384,859 titled TETRAZOLIUM SALT PHOTOREDUCTIVE IMAGING, filed Aug. 2, 1973, now U.S. Pat. No. 3,887,374.

It has been discovered that quinones incorporating one or more labile hydrogen atoms are more easily photoconverted into a reducing agent precursor or reducing agent than quinones which do not incorporate labile hydrogen atoms. Even when quinones lacking labile hydrogen atoms are employed in combination with an external hydrogen source while incorporated hydrogen source quinones are similarly employed without external hydrogen source compounds, the internal hydrogen source quinones continue to exhibit greater ease of photo-conversion. When internal hydrogen source quinones are employed with external hydrogen source compounds, their ease of photoconversion can generally be further improved, although the improvement is greater for those internal hydrogen source quinones which are less effective when employed without an external hydrogen source compound.

Using quinones exhibiting greater ease of photoconversion results in photographic elements which exhibit improved image densities for comparable exposures and which produce comparable image densities with lesser exposure times. Hence, incorporated hydrogen source quinones can be employed to achieve greater photographic speeds and/or image densities.

Particularly preferred internal hydrogen source quinones are 5,8-dihydro-1,4-naphthoquinones having at least one hydrogen atom in each of the 5 and 8 ring positions. Other preferred incorporated hydrogen source quinones are those which have a hydrogen atom bonded to a carbon atom to which is also bonded the oxygen atom of any oxy substituent, such as a hydroxyl group, or a nitrogen atom of an amine substituent, with the further provision that the carbon to hydrogen bond is the third or fourth bond removed from at least one quinone carbonyl double bond. As employed herein the term "amine substituent" is inclusive of amide and imine substituents. Disubstituted amino substituents are preferred. 1,4-Benzoquinones and naphthoquinones having one or more 1' or 2'-hydroxyalkyl, alkoxy (including alkoxyalkoxy—particularly, 1' or 2' alkoxyalkoxy, hydroxyalkoxy, etc.), 1' or 2'-alkoxyalkyl, aralkoxy, 1' or 2'-acyloxyalkyl, 1' or 2'-aryloxyalkyl, aryloxyalkoxy, 1' or 2'-aminoalkyl (preferably a 1' or 2'-aminoalkyl in which the amino group contains two substituents in addition to the alkyl substituent, 1' or 2'-aroyloxyalkyl, alkylarylamino, dialkylamino, N,N-bis(1-cyanoalkyl-)amino, N-aryl-N-(1-cyanoalkyl)amino, N-alkyl-N-(1-cyanoalkyl)amino, N,N-bis(1-carbalkoxyalkyl)amino, N-aryl-N-(1-carbalkoxyalkyl)-amino, N-alkyl-N-(1-carbalkoxyalkyl)amino, N,N-bis(1-nitroalkyl)amino, N-alkyl-N-(1-nitroalkyl)amino, N-aryl-N-(1-nitroalkyl-)amino, N,N-bis(1-acylalkyl)amino, N-alkyl-N-(1-acylalkyl)amino, N-aryl-N-(1-acylalkyl)amino, pyrrolino, pyrrolidino, piperidine, and/or morpholino substituents in 2 and/or 3 position are particularly preferred. Other substituents can, of course, be present. Unsubstituted 5,8-dihydro-1,4-naphthoquinone and 5,8-dihydro-1,4-naphthoquinones substituted at least in the 2 and/or 3 position with one or more of the above-listed preferred quinone substituents also constitute preferred internal hydrogen source quinones. It is recognized that additional fused rings can be present within the incorporated hydrogen source quinones. For example, 1,4-dihydro-anthraquinones represent a useful species of 5,8-dihydro-1,4-naphthoquinones useful as incorporated hydrogen source quinones. The aryl substituents and substituent moieites of incorporated hydrogen source quinones are preferably phenyl or phenylene while the aliphatic hydrocarbon substituents and substituent moieties preferably incorporate twenty or fewer carbon atoms and, most preferably, six or fewer carbon atoms. Exemplary preferred internal hydrogen source quinones are set forth in Table I.

TABLE I

| Exemplary Internal Hydrogen Source Quinones | |
|---|---|
| PR-1 | 5,8-dihydro-1,4-naphthoquinone |

TABLE I-continued

| Exemplary Internal Hydrogen Source Quinones | |
|---|---|
| PR-2 | 5,8-dihydro-2,6,7-trimethyl-1,4-naphthoquinone |
| PR-3 | 5,8-dihydro-6,7-dimethyl-2-phenyl-1,4-naphthoquinone |
| PR-4 | 5,8-dihydro-2,5,8-trimethyl-1,4-naphthoquinone |
| PR-5 | 2,5-bis(dimethylamino)-1,4-benzoquinone |
| PR-6 | 2,5-dimethyl-3,6-bis(dimethylamino)-1,4-benzoquinone |
| PR-7 | 2,5-dimethyl-3,6-bispyrrolidino-1,4-benzoquinone |
| PR-8 | 2-ethoxy-5-methyl-1,4-benzoquinone |
| PR-9 | 2,6-dimethoxy-1,4-benzoquinone |
| PR-10 | 2,5-dimethoxy-1,4-benzoquinone |
| PR-11 | 2,6-diethoxy-1,4-benzoquinone |
| PR-12 | 2,5-diethoxy-1,4-benzoquinone |
| PR-13 | 2,5-bis(2-methoxyethoxy)-1,4-benzoquinone |
| PR-14 | 2,5-bis(β-phenoxyethoxy)-1,4-benzoquinone |
| PR-15 | 2,5-diphenethoxy-1,4-benzoquinone |
| PR-16 | 2,5-di-n-propoxy-1,4-benzoquinone |
| PR-17 | 2,5-di-isopropoxy-1,4-benzoquinone |
| PR-18 | 2,5-di-n-butoxy-1,4-benzoquinone |
| PR-19 | 2,5-di-sec-butoxy-1,4-benzoquinone |
| PR-20 | 2-(N-ethylacetamidomethyl)-5-tert-butyl-1,4-benzoquinone |
| PR-21 | 1,1'-bis(5-methyl-1,4-benzoquinone-2-yl)-diethyl ether |
| PR-22 | 2-methyl-5-morpholinomethyl-1,4-benzoquinone |
| PR-23 | 2,3,5-trimethyl-6-morpholinomethyl-1,4-benzoquinone |
| PR-24 | 2,5-bis(morpholinomethyl)-1,4-benzoquinone |
| PR-25 | 2-(1-hydroxy-2-methyl-n-propyl)-5-methyl-1,4-benzoquinone |
| PR-26 | 2-hydroxymethyl-3,5,6-trimethyl-1,4-benzoquinone |
| PR-27 | 2-(1-hydroxyethyl)-5-methyl-1,4-benzoquinone |
| PR-28 | 2-(1-hydroxy-n-propyl)-5-methyl-1,4-benzoquinone |
| PR-29 | 2-(1-hydroxy-n-octyl)-5-methyl-1,4-benzoquinone |
| PR-30 | 2-(1,1-dimethyl-2-hydroxyethyl)-5-methyl-1,4-benzoquinone |
| PR-31 | 2-(1-acetoxyethyl)-5-methyl-1,4-benzoquinone |
| PR-32 | 2-(1-methoxyethyl)-5-methyl-1,4-benzoquinone |
| PR-33 | 2-(1-ethoxyethyl)-5-methyl-1,4-benzoquinone |
| PR-34 | 2-(1-isopropoxyethyl)-5-methyl-1,4-benzoquinone |
| PR-35 | 2-chloro-3-n-octylamino-1,4-naphthoquinone |
| PR-36 | 1,4-dihydro-1,4-dimethylanthraquinone |
| PR-37 | 1,4-dihydro-2,3-dimethylanthraquinone |
| PR-38 | 2-dimethylamino-1,4-naphthoquinone |
| PR-39 | 2-methoxy-1,4-naphthoquinone |
| PR-40 | 2-benzyloxy-1,4-naphthoquinone |
| PR-41 | 2-methoxy-3-chloro-1,4-naphthoquinone |
| PR-42 | 2,3-dimethoxy-1,4-naphthoquinone |
| PR-43 | 2,3-diethoxy-1,4-naphthoquinone |
| PR-44 | 2-ethoxy-1,4-naphthoquinone |
| PR-45 | 2-phenethoxy-1,4-naphthoquinone |
| PR-46 | 2-(2-methoxyethoxy)-1,4-naphthoquinone |
| PR-47 | 2-(2-ethoxyethoxy)-1,4-naphthoquinone |
| PR-48 | 2-(2-phenoxy)ethoxy-1,4-naphthoquinone |
| PR-49 | 2-ethoxy-5-methoxy-1,4-naphthoquinone |
| PR-50 | 2-ethoxy-6-methoxy-1,4-naphthoquinone |
| PR-51 | 2-ethoxy-7-methoxy-1,4-naphthoquinone |
| PR-52 | 2-n-propoxy-1,4-naphthoquinone |
| PR-53 | 2-(3-hydroxypropoxy)-1,4-naphthoquinone |
| PR-54 | 2-isopropoxy-1,4-naphthoquinone |
| PR-55 | 7-methoxy-2-isopropoxy-1,4-naphthoquinone |
| PR-56 | 2-n-butoxy-1,4-naphthoquinone |
| PR-57 | 2-sec-butoxy-1,4-naphthoquinone |
| PR-58 | 2-n-pentoxy-1,4-naphthoquinone |
| PR-59 | 2-n-hexoxy-1,4-naphthoquinone |
| PR-60 | 2-n-heptoxy-1,4-naphthoquinone |
| PR-61 | 2-acetoxymethyl-3-methyl-1,4-naphthoquinone |
| PR-62 | 2-methoxymethyl-3-methyl-1,4-naphthoquinone |
| PR-63 | 2-(β-acetoxyethyl)-1,4-naphthoquinone |
| PR-64 | 2-N,N-bis(cyanomethyl)aminomethyl-3-methyl-1,4-naphthoquinone |
| PR-65 | 2-methyl-3-morpholinomethyl-1,4-naphthoquinone |
| PR-66 | 2-hydroxymethyl-1,4-naphthoquinone |
| PR-67 | 2-hydroxymethyl-3-methyl-1,4-naphthoquinone |
| PR-68 | 2-(1-hydroxyethyl)-1,4-naphthoquinone |
| PR-69 | 2-(2-hydroxyethyl)-1,4-naphthoquinone |
| PR-70 | 2-(1,1-dimethyl-2-hydroxyethyl)-1,4-naphthoquinone |
| PR-71 | 2-bromo-3-isopropoxy-1,4-naphthoquinone |
| PR-72 | 2-ethoxy-3-methyl-1,4-naphthoquinone |
| PR-73 | 2-chloro-3-piperidino-1,4-naphthoquinone |
| PR-74 | 2-morpholino-1,4-naphthoquinone |
| PR-75 | 2,3-dipiperidino-1,4-naphthoquinone |

While internal hydrogen source quinones constitute preferred internal hydrogen source photoreductants, it is appreciated that other photoreductants can also be provided with one or more labile hydrogen atoms and employed as internal hydrogen source photoreductants in accordance with the teachings of this invention. For example, a photoreductant such as a nitroarene can be converted to an internal hydrogen source photoreductant by incorporation of a hydroxyalkyl or alkoxy substituent to provide a source of labile hydrogen atoms. The arene ring can be any aromatic carbocyclic ring structure—e.g., phenyl, naphthyl, anthryl or similar ring structures. The alkyl moiety can have up to twenty carbon atoms and preferably has six or fewer carbon atoms. Exemplary of specific internal hydrogen source nitroarene photoreductants are 2-nitrobenzyl alcohol, 2-(1-hydroxyethyl)-1-nitronaphthalene, and 2-ethoxy-1-nitronaphthalene.

While it is not necessary to provide a separate hydrogen source in order to photoreduce the internal hydrogen source photoreductants of this invention, it is recognized that the ease of photoreduction can be enhanced by utilizing an external hydrogen source compound in combination with some internal hydrogen source photoreductants. Any conventional source of labile hydrogen atoms that is not otherwise reactive with the remaining components or their reaction products contained within the photographic element can be utilized. Generally preferred for use are organic compounds having a hydrogen atom attached to a carbon atom to which a substituent is also attached which greatly weakens the carbon to hydrogen bond, thereby rendering the hydrogen atom labile. Preferred hydrogen source compounds are those which have a hydrogen atom bonded to a carbon atom to which is also bonded the oxygen atom of an oxy substituent and/or the trivalent nitrogen atom of an amine substituent. As employed herein the term "amine substituent" is inclusive of amide and imine substituents. Exemplary preferred substituents which produce marked lability in a hydrogen atom associated with a common carbon atom are oxy substituents, such as hydroxy, alkoxy, aryloxy, alkaryloxy and aralkoxy substituents and amino substituents, such as alkylarylamino, diarylamino, N,N-bis(1-cyanoalkyl)amino, N-aryl-N-(1-cyanoalkyl)amino, N-alkyl-N-(1-cyanoalkyl)amino, N,N-bis(1-carbalkoxyalkyl)amino, N-aryl-N-(1-carbalkoxyalkyl)amino, N-alkyl- N-(1-carbalkoxyalkyl)amino, N,N-bis(1-nitroalkyl-)amino, N-alkyl-N-(1-nitroalkyl)amino, N-aryl-N-(1-nitroalkyl)amino, N,N-bis(1-acylalkyl)amino, N-alkyl-N-(1-acylalkyl)amino, N-aryl-N-(1-acylalkyl)amino, and the like. The aryl substituents and substituent moieties are preferably phenyl or phenylene while the aliphatic hydrocarbon substituents and substituent moieties preferably incorporate twenty or fewer carbon atoms and, most preferably, six or fewer carbon atoms. Exemplary of compounds which can be used in the practice of this invention for the purpose of providing a ready source of labile hydrogen atoms are those set forth in Table II. Compounds known to be useful in providing labile hydrogen atoms are also disclosed in U.S. Pat. No. 3,383,212 issued May 14, 1968, the disclosure of which is here incorporated by reference.

TABLE II

| Exemplary External Hydrogen Source Compounds | |
|---|---|
| HS-1 | poly(ethylene glycol) |
| HS-2 | phenyl-1,2-ethanediol |
| HS-3 | nitrilotriacetonitrile |
| HS-4 | triethylnitrilotriacetate |
| HS-5 | poly(ethylene glycol) |
| HS-6 | poly(vinyl butyral) |
| HS-7 | poly(vinyl acetal) |
| HS-8 | 1,4-benzenedimethanol |
| HS-9 | methyl cellulose |
| HS-10 | cellulose acetate butyrate |
| HS-11 | 2,2-bis-(hydroxymethyl)-propionic acid |
| HS-12 | 1,3-bis-(hydroxymethyl)-urea |
| HS-13 | 4-nitrobenzyl alcohol |
| HS-14 | 4-methoxybenzyl alcohol |
| HS-15 | 2,4-dimethoxybenzyl alcohol |
| HS-16 | 3,4-dichlorophenylglycol |
| HS-17 | N-(hydroxymethyl)-benzamide |
| HS-18 | N-(hydroxymethyl)-phthalimide |
| HS-19 | 5-(hydroxymethyl)-uracil hemihydrate |
| HS-20 | nitrilotriacetic acid |
| HS-21 | 2,2',2"-triethylnitrilotripropionate |
| HS-22 | 2,2',2"-nitrilotriacetophenone |
| HS-23 | poly(vinyl acetate) |
| HS-24 | poly(vinyl alcohol) |
| HS-25 | ethyl cellulose |
| HS-26 | carboxymethyl cellulose |
| HS-27 | poly(vinyl formal) |

TETRAZOLIUM SALTS AS THE IMAGING MEANS

This invention can be practiced utilizing any tetrazolium salt which on reduction forms a formazan dye of a detectibly different color. A wide variety of such tetrazolium salts are known to the art including bis-tetrazolium salts linked directly or through intervening divalent radicals in the 2 or 5 positions. As is well understood by those skilled in the art, tetrazolium salts require for preparation the presence of aromatic (e.g., phenyl, naphthyl, anthryl, etc.) or aromatic-like (e.g., pyridyl, oxazolyl, thiazolyl, quinolinyl, benzoxazolyl, benzothiazolyl, etc.) substituents in the 2 and 3 positions of the tetrazole nucleus. For purposes of illustration an exemplary list of suitable known tetrazolium salts are set forth in Tables III, IV, and V.

It is recognized that some tetrazolium salts are yellow or can become yellow when exposed to light for an extended period in the imaging layer. To be useful in the practice of this invention it is required only that the tetrazolium salt incorporated into the image-forming layer undergo a detectible color change upon reduction to the corresponding dye. Since the formazan dyes are for the most part red and of significantly higher optical densities than their parent tetrazolium salts, they produce a sharp visible contrast with yellow, white or transparent background areas. Of course, white or fully transparent backgrounds present minimum optical densities (hence highest contrast), and for this reason it is generally preferred to choose tetrazolium salts that remain colorless until reduced to the corresponding dye. Additionally, aesthetic considerations dictate white or transparent backgrounds for many applications.

TABLE III

| Exemplary Dye Forming Tetrazolium Salts | |
|---|---|
| T-1 | 2,3,5-triphenyl-2H-tetrazolium chloride |
| T-2 | 2-(2-methylphenyl)-3,5-diphenyl-2H-tetrazolium tetrafluoroborate |
| T-3 | 2-(4-chlorophenyl)-3,5-diphenyl-2H-tetrazolium tetrafluoroborate |
| T-4 | 2,3-diphenyl-5-(4-chlorophenyl)-2H-tetrazolium tetrafluoroborate |
| T-5 | 2-(4-iodophenyl)-3,5-diphenyl-2H-tetrazolium tetrafluoroborate |
| T-6 | 2-(4-chlorophenyl)-3-(2-chlorophenyl)-5-(2-pyridyl)-2H-tetrazolium iodide |
| T-7 | 2,3-diphenyl-2H-tetrazolium sulfate |
| T-8 | 2-(2-methoxyphenyl)-3,5-diphenyl-2H-tetrazolium tetrafluoroborate |
| T-9 | 2,3-diphenyl-5-methyl-2H-tetrazolium chloride |
| T-10 | 2,3-diphenyl-5-dodecyl-2H-tetrazolium chloride |
| T-11 | 5-(3-iodophenyl)-2,3-diphenyl-2H-tetrazolium chloride |
| T-12 | 5-cyano-2,3-diphenyl-2H-tetrazolium chloride |
| T-13 | 5-acetyl-2,3-diphenyl-2H-tetrazolium chloride |
| T-14 | 2,5-diphenyl-3-(4-tolyl)-2H-tetrazolium bromide |
| T-15 | 2,5-diphenyl-3-(4-biphenylyl)2H-tetrazolium chloride |
| T-16 | 2,3-diphenyl-5-(2-chlorophenyl)-2H-tetrazolium iodide |
| T-17 | 5-(3,4-dimethoxyphenyl)-3-(4-nitrophenyl)-2-phenyl-2H-tetrazolium iodide |
| T-18 | 2,3-diphenyl-5-nitro-2H-tetrazolium chloride |
| T-19 | 2,3-diphenyl-5-(2-naphthyl)-2H-tetrazolium chloride |
| T-20 | ethylenebis[5-(2,3-diphenyl-2H-tetrazolium chloride)] |
| T-21 | 1,6-hexylenebis[5-(2,3-diphenyl-2H-tetrazolium chloride)] |
| T-22 | 1,4-phenylenebis[5-(2,3-diphenyl-2H-tetrazolium chloride)] |
| T-23 | 4,4'-biphenylylenebis[2-(5-methyl-3-phenyl-2H-tetrazolium chloride)] |
| T-24 | 4,4'-phenylene sulfoxide-bis[2-(3,5-diphenyl-2H-tetrazolium chloride)] |
| T-25 | 4,4'-biphenylylenebis[2-(3-diphenyl-5-(3,4-methylenedioxyphenyl-2H-tetrazolium chloride)] |
| T-26 | 2-phenyl-3-(4-nitrophenyl)-5-undecyl-2H-tetrazolium chloride |
| T-27 | 2,3-diphenyl-5-carbethoxy-2H-tetrazolium chloride |
| T-28 | 5-carbohexoxy-2,3-diphenyl-2H-tetrazolium chloride |
| T-29 | 5-acetyl-2-phenyl-3-(4-chlorophenyl)-2H-tetrazolium tetrafluoroborate |
| T-30 | 2,3-diphenyl-5-(1-naphthyl)-2H-tetrazolium bromide |
| T-31 | 2-(2,4,6-trichlorophenyl)-3,5-diphenyl-2H-tetrazolium tetrafluoroborate |
| T-32 | 2-(3,4-dichlorophenyl)-3,5-diphenyl-2H-tetrazolium tetrafluoroborate |
| T-33 | 2,3-diphenyl-5-(3-nitrophenyl)-2H-tetrazolium tetrafluoroborate |
| T-34 | 2-(3-nitrophenyl)-3,5-diphenyl-2H-tetrazolium tetrafluoroborate |
| T-35 | 2,3-diphenyl-5-(4-nitrophenyl)-2H- |

TABLE III-continued

| Exemplary Dye Forming Tetrazolium Salts |
| --- |
| tetrazolium tetrafluoroborate |

For many applications it is preferred to use tetrazolium salts which produce formazan dyes exhibiting high image densities and having a low susceptibility to fading. A preferred class of such tetrazolium salts are those having substituents on the tetrazole nucleus which are, collectively, predominantly electronegative (i.e., electron withdrawing). Such tetrazolium salts are disclosed and claimed by Bailey in commonly assigned application Ser. No. 384,858, filed Aug. 2, 1973 titled PHOTOGRAPHIC ELEMENTS AND PROCESSES FOR PRODUCING FORMAZAN DYE IMAGES OF ENHANCED STABILITY now U.S. Pat. No. 3,887,372. Particularly stable tetrazolium salts are those having tetrazole nucleus substituent the algebraic sum of whose Hammett sigma values is collectively greater than 0.78 and, preferably, greater than 1.00. If one or more of the substituent rings is in turn substituted at only one ring position adjacent to the ring-to-nucleus bonding position—i.e., the ring position (or positions) ortho to the bonding position, the algebraic sum of the sigma values for all tetrazole nucleus substituents need only be greater than 0.40 and, preferably, 0.50 in order to achieve the advantage of significantly improved image densities and dye stabilities. When two such ortho position substituents are present in a single substituent ring, however, they are essentially subtractive in effect. For example, two like ortho substituents on a 2, 3, or 5 position phenyl ring of a tetrazolium salt are substantially self-cancelling in effect. A comparable tetrazolium salt having only one ortho substituent and having summed Hammett sigma values for all substituents of 0.40 or greater exhibits marked stability. If a 2,3-diphenyl or 2,3,5-triphenyl-2H-tetrazolium salt has no ortho substituents (or cancelling ortho substituents), but has meta and/or para substituents so that the summed sigma values for the phenyl rings are greater than 0.78, then the salt exhibits a marked improvement in its stability.

In certain applications it can be advantageous to produce formazan dye images that fade at an accelerated rate. For example, it may be desirable to form a slide in which the image or a portion thereof disappears while being viewed or after a prescribed period of projection. By incorporating a predominance of electron donating (electropositive) substituents in the tetrazolium salts used in the practice of this invention the fading characteristics of the resulting formazan dyes can be augmented.

The tetrazolium salts used in the preferred practice of this invention can be comprised of any desired combination of 2,3 and, optionally, 5 position aromatic or aromatic-like heterocyclic rings, such as phenyl, naphthyl, anthryl, quinolinyl, pyridyl, azolyl, and the like. Typical azolyl rings include oxazolyl, thiazolyl, benzoxazolyl, benzothiazolyl and the like. These rings can in turn carry substituents. Exemplary of specifically contemplated ring substituents are lower alkyl (i.e., one to six carbon atoms), lower alkenyl (i.e., two to six carbon atoms), lower alkynyl (i.e., two to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyanide, azide, nitro, haloalkyl (e.g., trifluoromethyl, trifluoroethyl, etc.), amino (e.g., dimethylamino), amido (e.g, acetamido, benzamido), ammonium (e.g., trimethylammonium), azo (e.g., phenylazo), sulfonyl (e.g., methylsulfonyl, phenylsulfonyl), sulfoxide (e.g., methylsulfoxide), sulfonium (e.g., dimethyl sulfonium), silane (e.g., trimethylsilane) and thioether (e.g., methyl mercaptide) substituents.

Hammett sigma values for the substituents of the tetrazole nucleus can be determined by reference to the published literature or can be determined directly using known determination procedures. Exemplary meta and para sigma values and procedures for their determination are set forth by H. VanBekkum, P. E. Verkade and B. M. Wepster in Rec. Trav. Chem, volume 78, page 815, published 1959; by P. R. Wells in Chem.Revs., volume 63, page 171, published 1963; by H. H. Jaffe, Chem. Revs., volume 53, page 191, published 1953; by M. J. S. Dewar and P. J. Grisdale in J. Amer. Chem. Soc., volume 84, page 3548, published 1962; and by Barlin and Perrin in Quart. Revs., volume 20, page 75 et seq., published 1966.

In accordance with established practice electron withdrawing (electronegative) substituents are assigned positive sigma values while electron donating (electropositive) substituents are assigned negative sigma values. Each tetrazole nucleus substituent is assigned a Hammett sigma value which is the algebraic sum of its unsubstituted sigma value and the sigma value of its own substituents, if any. For example, unsubstituted phenyl tetrazole nucleus substituents have neutral sigma values, while the sigma values of substituted phenyl tetrazole nucleus substituents can be determined algebraically simply by determining from the literature the known Hammett sigma values for each substituent and obtaining the algebraic sum thereof. Other tetrazole nucleus substituents, particularly heterocyclic tetrazole nucleus substituents, can exhibit sigma values even when unsubstituted. For example, a 2-pyridyl substituent exhibits a sigma value of 0.56; a 3-pyridyl substituent exhibits a sigma value of 0.73; a 4-pyridyl substituent exhibits a sigma value of 0.83; a 2-thiazolyl substituent exhibits a sigma value of approximately 0.5; a 2-oxazolyl substituent exhibits a sigma value of 0.75. It is then apparent that a tetrazolium salt including an unsubstituted 4-pyridyl or 2-pyridyl substituent constitutes a preferred, stabilized dye producing tetrazolium salt, provided the remaining tetrazole nucleus substituents are on balance neutral or electronegative in their sigma values.

Sigma values for a given substituent are noted to vary as a function of ring position and resonance induced by conjugation. For example, a given substituent to a phenyl ring can exhibit one sigma value in the meta position and another when in the para position. A few substituents, such as nitro, dimethylamino and cyano substituents, for example, produce a conjugated system as para position substituents to 2 and 3 position phenyl rings and accordingly are assigned differing sigma values depending on the ring to which they are appended. For the purpose of assigning sigma values in accordance with the teachings of this invention the sigma value for an ortho substituent is considered to be identical to the non-conjugated para position sigma value for that substituent. Certain illustrative Hammett sigma values for ring substituents of triphenyltetrazolium salts are set forth in Table IV.

TABLE IV

Exemplary Hammett Sigma Values For Triphenyltetrazolium Salt Substituents

| Substituent | meta | Ortho/para |
|---|---|---|
| $-N(CH_3)_2$ | +0.05 | +0.12[a] |
| $-t\text{-}C_4H_9$ | −0.07 | −0.14 |
| $-C_2H_5$ | −0.07 | −0.12 |
| $-CH_3$ | −0.07 | −0.13 |
| $-OCH_3$ | +0.08 | 0.17 |
| $-Si(CH_3)_3$ | −0.05 | +0.01 |
| $-H$ | ≡0.0 | ≡0.0 |
| $-C_6H_5$ | +0.06 | 0.0 |
| $-F$ | +0.34 | +0.08 |
| $-Cl$ | +0.37 | +0.25 |
| $-Br$ | +0.39 | +0.27 |
| $-I$ | +0.35 | +0.30 |
| $-CN$ | +0.62 | +0.65[b] |
| $-NO_2$ | +0.71 | +0.78[c] |
| $-C(O)CH_3$ | +0.38 | +0.50 |
| $-SO_2CH_3$ | +0.68 | +0.68 |
| $-N(CH_3)_3^+$ | +0.86 | +0.80 |
| $-CO_2CH_3$ | +0.32 | +0.39 |
| $-CHO$ | +0.38 | +1.00 |
| $-SCH_3$ | +0.22 | +0.22 |
| $-S(CH_3)_2^+$ | +1.0 | +1.2 |
| $-CF_3$ | +0.47 | +0.53 |

[a] 0.60 for 2 and 3 position phenyl rings as para substituent
[b] +0.75 for 2 and 3 position phenyl rings as para substituent
[c] +0.95 for 2 and 3 position phenyl rings as para substituent Exemplary preferred tetrazolium salts having predominately electronegative tetrazole nucleus substituents are set forth in Table V. These tetrazolium salts in all instances incorporate tetrazole nucleus substituents the summed sigma values of which are equal to or greater than those required to impart enhanced stability to the corresponding formazan dye—i.e., greater than 0.78 or, in the case of tetrazolium salts having a substituent ring which is in turn singly substituted at a carbon atom adjacent the bonding carbon atom, greater than 0.40.

TABLE V

Exemplary Preferred Tetrazolium Salts for forming Dyes of Enhanced Stability

| | Tetrazolium Salt |
|---|---|
| T-36 | 2-(4-methylthiophenyl)-3-(3,5-dichlorophenyl)-5-(3-nitrophenyl)-2H-tetrazolium hexafluorophosphate |
| T-37 | 2(4-cyanophenyl)-3-(3-benzamidophenyl)-5-(3,4-dichlorophenyl)-2H-tetrazolium perchlorate |
| T-38 | 2-(2-naphthyl)-3-(3-nitro-5-chlorophenyl)-5-(4-cyanophenyl)-2H-tetrazolium sulfate |
| T-39 | 2-(4-bromo-1-naphthyl)-3-(4-cyanophenyl)-5-(3,4-dichlorophenyl)-2H-tetrazolium chloride |
| T-40 | 2-(3-pyridyl)-3-phenyl-5-(4-chlorophenyl)-2H-tetrazolium bromide |
| T-41 | 2-(2,4-dichlorophenyl)-3-(4-nitrophenyl)-5-phenyl-2H-tetrazolium tetrafluoroborate |
| T-42 | 2-(2,4,5-trichlorophenyl)-3-(4-nitrophenyl)-5-phenyl-2H-tetrazolium tetrafluoroborate |
| T-43 | 2-(2,4,5-trichlorophenyl)-3-(4-phenylsulfonyl phenyl)-5-phenyl-2H-tetrazolium chloride |
| T-44 | 2-(2,3,4,5-tetrachlorophenyl)-3-(4-nitrophenyl)-5-phenyl-2H-tetrazolium iodide |
| T-45 | 2-(2-trifluoromethyl-5-chlorophenyl)-3-(4-cyanophenyl)-5-phenyl-2H-tetrazolium bromide |
| T-46 | 2-(4-pyridyl)-3-(2-trifluoromethyl-phenyl)-5-phenyl-2H-tetrazolium tetrafluoroborate |
| T-47 | 2-(2-chloro-5-trifluoromethylphenyl)-3-(3,4-dichlorophenyl)-5-phenyl-2H-tetrazolium hexafluorophosphate |
| T-48 | 2-(2-chloro-5-nitrophenyl)-3-(4-acetyl phenyl)-5-(3-nitrophenyl)-2H-tetrazolium chloride |
| T-49 | 2-(2-chloro-4-cyanophenyl)-3-(4-benzoyl-phenyl)-5-(3-chlorophenyl)-2H-tetrazolium perchlorate |
| T-50 | 2-(2-nitro-4-chlorophenyl)-3-(4-phenyl-azophenyl)-5-(4-chlorophenyl)-2H-tetrazolium chloride |
| T-51 | 2-[4-(4-nitrophenyl)thiophenyl]-3-(2-chloro-5-trifluoromethylphenyl)-5-(3-nitrophenyl)-2H-tetrazolium bromide |
| T-52 | 2-(4-phenylsulfonylphenyl)-3-(2-chloro-5-trifluoromethyl phenyl)-5-(3,4-dichloro-phenyl)-2H-tetrazolium bromide |
| T-53 | 2-(4-benzylphenyl)-3-(2,4-dichlorophenyl)-5-(4-nitrophenyl)-2H-tetrazolium sulfate |
| T-54 | 2-(4-phenylsulfonylphenyl)-3-(2-chloro-4-cyanophenyl)-5-(3,4-dichlorophenyl)-2H-tetrazolium chloride |
| T-55 | 2-(2-methoxy-4-nitrophenyl)-3-(4-cyano-phenyl)-5-phenyl-2H-tetrazolium chloride |
| T-56 | 2-(3-propionylphenyl)-3-(2,4-dichloro-phenyl)-5-(3-nitrophenyl)-2H-tetrazolium chloride |
| T-57 | 2-(2-biphenyl)-3-(3,4-dichlorophenyl)-5-(4-cyanophenyl)-2H-tetrazolium chloride |
| T-58 | 2-(4-nitrophenyl)-3-(3-pyridyl)-5-phenyl-2H-tetrazolium perchlorate |
| T-59 | 2-(2-chloro-4-cyanophenyl)-3-(2-chloro-5-trifluoromethylphenyl)-5-(3-chlorophenyl)-2H-tetrazolium tetrafluoroborate |
| T-60 | 2-(4-pyridyl)-3-(2,3,4,5-tetrafluorophenyl)-5-phenyl-2H-tetrazolium hexafluorophosphate |
| T-61 | 2-(2-benzoylphenyl)-3-(2,4-dichlorophenyl)-5-(3-nitrophenyl)-2H-tetrazolium hexafluorophosphate |
| T-62 | 2-(1-nitro-2-naphthyl)-3-(2-methyl-4-nitrophenyl)-5-(4-chlorophenyl)-2H-tetrazolium chloride |
| T-63 | 2-(3-phenylformamidophenyl)-3-(2-nitro-4-chlorophenyl)-5-(3-chlorophenyl)-2H-tetrazolium tetrafluoroborate |
| T-64 | 2-(anthraquinone-2-yl)-3-(2-nitro-4-chlorophenyl)-5-(4-cyanophenyl)-2H-tetrazolium tetrafluoroborate |
| T-65 | 2-(2,5-dichlorophenyl)-3-phenyl-5-(4-nitrophenyl)-2H-tetrazolium tetrafluoroborate |
| T-66 | 2-(2,4-dibromophenyl)-3-(4-nitrophenyl)-5-methyl-2H-tetrazolium chloride |
| T-67 | 2-(2,5-dichlorophenyl)-3-(2-methoxy-4-nitrophenyl)-5-(4-methoxyphenyl)-2H-tetrazolium chloride |
| T-68 | 2-(2,4,5-trichlorophenyl)-3-(3-nitro-phenyl)-5-ethyl-2H-tetrazolium bromide |
| T-69 | 2-(4-trifluoromethylphenyl)-3-(4-cyano-phenyl)-5-n-propyl-2H-tetrazolium bromide |
| T-70 | 2-(2-phenoxy-4-chlorophenyl)-3-(4-nitrophenyl)-5-n-hexyl-2H-tetrazolium tetrafluoroborate |
| T-71 | 2-(2-bromophenyl)-3-(2-nitrophenyl)-5-phenyl-2H-tetrazolium tetrafluoroborate |
| T-72 | 2,3-di(4-nitrophenyl)-5-methyl-2H-tetrazolium hexafluorophosphate |
| T-73 | 2-(4-bromophenyl)-3-(4-nitrophenyl)-5-tert-butyl-2H-tetrazolium tetrafluoroborate |
| T-74 | 2-(4-iodophenyl)-3-(4-nitrophenyl)-5-phenyl-2H-tetrazolium chloride |
| T-75 | 2-(2-nitro-1-naphthyl)-3-(4-cyanophenyl)-5-methyl-2H-tetrazolium tetrafluoroborate |

TABLE V-continued

| | Exemplary Preferred Tetrazolium Salts for forming Dyes of Enhanced Stability |
|---|---|
| | Tetrazolium Salt |
| T-76 | 2-(2-nitro-4-chloro-1-naphthyl)-3-(4-trifluoromethylphenyl)-5-methyl-2H-tetrazolium perchlorate |
| T-77 | 2-(2-bromo-4-cyano-1-naphthyl)-3-(4-nitrophenyl)-5-n-propyl-2H-tetrazolium chloride |
| T-78 | 2-(1-bromo-4-nitro-2-naphthyl)-3-(3,4-dichlorophenyl)-5-ethyl-2H-tetrazolium hexafluorophosphate |
| T-79 | 2-(3,6,7-trichloro-1-naphthyl)-3-(4-nitrophenyl)-5-n-hexyl-2H-tetrazolium hexafluorophosphate |
| T-80 | 2-(5-nitro-2-naphthyl)-3-(2,4,5-trichlorophenyl)-5-isobutyl-2H-tetrazolium hexafluorophosphate |
| T-81 | 2-(5,8-dichloro-1-naphthyl)-3-(4-nitrophenyl)-5-methyl-2H-tetrazolium sulfate |
| T-82 | 2-(3,5-dibromo-2-naphthyl)-3-(4-chlorophenyl)-5-propyl-2H-tetrazolium iodide |
| T-83 | 2,3-di(2-chlorophenyl)-5-phenyl-2H-tetrazolium tetrafluoroborate |
| T-84 | 2-(2-nitrophenyl)-3,5-diphenyl-2H-tetrazolium tetrafluoroborate |
| T-85 | 2-(2-chloro-4-nitrophenyl)-3,5-diphenyl-2H-tetrazolium tetrafluoroborate |
| T-86 | 2-(2-chlorophenyl)-3-phenyl-5-(3-nitrophenyl)-2H-tetrazolium tetrafluoroborate |
| T-87 | 2-(2,4-dinitrophenyl)-3,5-diphenyl-2H-tetrazolium tetrafluoroborate |
| T-88 | 2,3,5-tri(4-nitrophenyl)-2H-tetrazolium chloride |
| T-89 | 2-(2-methyl-4-nitrophenyl)-3,6-diphenyl-2H-tetrazolium tetrafluoroborate |
| T-90 | 2-(4-nitrophenyl)-3,5-diphenyl-2H-tetrazolium tetrafluoroborate |
| T-91 | 2-(4-iodophenyl)-3-(4-nitrophenyl)-5-phenyl-2H-tetrazolium tetrafluoroborate |
| T-92 | 2-(4-nitrophenyl-3-phenyl-5-(4-chlorophenyl)-2H-tetrazolium tetrafluoroborate |
| T-93 | 2,3-di(4-nitrophenyl)-5-phenyl-2H-tetrazolium tetrafluoroborate |
| T-94 | 2,5-di(4-nitrophenyl)-3-phenyl-2H-tetrazolium tetrafluoroborate |
| T-95 | 2,3-di(4-nitrophenyl)-5-(4-methoxyphenyl)-2H-tetrazolium tetrafluoroborate |
| T-96 | 2-(3-chlorophenyl)-3-(4-cyanophenyl)-5-(3,4-dichlorophenyl)-2H-tetrazolium iodide |
| T-97 | 2-(4-phenylsulfonyl phenyl)-3-(3,5-dichlorophenyl)-5-(4-cyanophenyl)-2H-tetrazolium chloride |
| T-98 | 2-(4-diphenyl)-3-(3,5-dinitrophenyl)-5-(4-trimethylammonium phenyl)-2H-tetrazolium dichloride |
| T-99 | 2-(4-acetylphenyl)-3-(3-trifluoromethyl-4-chlorophenyl)-5-(4-nitrophenyl)-2H-tetrazolium bromide |

Any anion known to be useful in formazan dye forming tetrazolium salts can be used in the practice of this invention. Preferred anions are those set forth in Tables III and V. Any one of these anions can be incorporated in place of any other anion in any of the tetrazolium salts set forth in Tables III and V. Non-basic, non-nucleophilic anions are preferred, such as tetrafluoroborate and hexafluorophosphate, for example. Such anions provide the resulting tetrazolium salt with enhanced protection against anion induced reduction, and for this reason their use is preferred.

It has been recognized prior to this invention that the color of the formazan dye can be influenced by the incorporation of various metal salts in combination with the tetrazolium salt. Jaeken et al, noted above, suggests the use of salts of metals such as iron, nickel, cobalt, copper, zinc, cadmium, chromium, titanium, molybdenum or tungsten, for this purpose. It is recognized that such metal salts can be used also in the practice of this invention for the purpose of chelating the formazan dye produced on exposure, thereby stabilizing the dye against subsequent fading. All formazan dyes are capable of forming at least bidentate chelates. While distinct stabilization is observed for bidentate and tridentate formazan dye chelates, the use of tetrazolium salts that form tridentate chelates gives greater stabilization and is preferred. Exemplary of tetrazolium salts capable of forming tridentate formazan dye chelates are those having one or more N-heterocyclic aromatic rings in the 2 or 3 position, such as 2-pyridyl, 2-quinolinyl and 2-azolyl (e.g., 2-thiazolyl, 2-benzothiazolyl, 2-oxazolyl, 2-benzoxazolyl, etc.) ring structures, for example. Certain exemplary preferred tetrazolium salts for forming highly stable tridentate formazan dye chelates are set forth in Table VI.

TABLE VI

| | Exemplary Preferred Tetrazolium Salts for Forming Tridentate Formazan Dye Chelates |
|---|---|
| T-100 | 2-(2-pyridyl)-3-(2,6-dimethylphenyl)-5-phenyl-2H-tetrazolium hexafluorophosphate |
| T-101 | 2-(2-pyridyl)-3-phenyl-5-n-hexyl-2H-tetrazolium tetrafluoroborate |
| T-102 | 2-(2-pyridyl)-3,5-diphenyl-2H-tetrazolium bromide |
| T-103 | 2-(benzothiazol-2-yl)-3,5-diphenyl-2H-tetrazolium bromide |
| T-104 | 2-(2-pyridyl)-3-(4-chlorphenyl)-5-phenyl-2H-tetrazolium nitrate |
| T-105 | 2,2'-di(thiazol)-3,3'-diphenyl-5,5'-diphenylene-di(2H-tetrazolium iodide) |
| T-106 | 2,3-di(benzothiazol-2-yl)-5-dodecyl-2H-tetrazolium chloride |
| T-107 | 2-phenyl-3-(benzothiazol-2-yl)-5-(3-chlorophenyl)-2H-tetrazolium chloride |
| T-108 | 2,3-di(benzothiazol-2-yl)-5-cyano-2H-tetrazolium chloride |
| T-109 | 2-phenyl-3-(benzothiazol-2-yl)-5-propyl-2H-tetrazolium iodide |
| T-110 | 3-(4,5-dimethylthiazol-2-yl)-2,5-diphenyl-2H-tetrazolium bromide |
| T-111 | 2-(2-pyridyl)-3,5-diphenyl-2H-tetrazolium tetrafluoroborate |
| T-112 | 2-(2-quinolinyl)-3-phenyl-5-(3-nitrophenyl)-2H-tetrazolium tetrafluoroborate |
| T-113 | 2-(2-pyridyl)-3-(2-tolyl)-5-(4-cyanophenyl)-2H-tetrazolium hexafluorophoshate |
| T-114 | 1,5-naphthalene-bis[3-[2-(2-pyridyl)-5-(3,4-dichlorophenyl)-2H-tetrazolium tetrafluoroborate]] |
| T-115 | 2-(2-pyridyl)-3-(4-nitrophenyl)-5-phenyl-2H-tetrazolium nitrate |
| T-116 | 2-(benzothiazol-2-yl)-3,5-di(4-chlorophenyl)-2H-tetrazolium chloride |
| T-117 | 2-(benzothiazol-2-yl)-3-(3-nitrophenyl)-5-(4-iodophenyl)-2H-tetrazolium tetrafluoroborate |
| T-118 | 2-(benzothiazol-2-yl)-3-(2-fluorophenyl)-5-(4-cyanophenyl)-2H-tetrazolium tetrafluoroborate |
| T-119 | 2-(4,5-dimethylthiazol-2-yl)-3-(3-trifluoromethylphenyl)-5-(4-bromophenyl)-2H-tetrazolium tetrafluoroborate |
| T-120 | 2-(benzoxazol-2-yl)-3-(4-chlorophenyl)-5-phenyl-2H-tetrazolium chloride |

In addition to greater stabilities, another advantage of chelated formazan dyes is that they are generally more absorptive in the red spectrum than the corresponding unchelated formazan dyes. Thus, whereas formazan dyes generally tend toward red images, chelated formazan dyes are considerably bluer, producing more neutral images.

From the foregoing it is apparent that the formazan dye images produced according to this invention can, if desired, be stabilized either by adding electronegative substituents to the tetrazole nucleus or by incorporating metal salts in combination with the tetrazolium salts. If desired, these two stabilization techniques can be used in combination. For example, the tetrazolium salts T-104 and T-112 through T-120 are sufficiently electronegative in their tetrazole nucleus substituents to constitute preferred tetrazolium salts in terms of stability, even without chelation. These tetrazolium salts can be used to produce formazan dyes of even greater stability by forming tridentate chelates.

If a metal salt is incorporated within the imaging layer for the purpose of chelating, some increase in background density can occur upon prolonged re-exposure to actinic radiation, unless the residual photoreductant, the remaining chelating metal salt, the unreduced tetrazolium salt or all of these are removed from the non-image areas. This can be accomplished, for example, by washing the photographic element in a suitable solvent, such as a polar solvent, like water, which does not attack or leach the formazan dye. To obtain minimal background densities and to avoid processing the photographic element after image formation, it is preferred to utilize tetrazolium salts with electronegative substituents that produce stabilized formazan dyes rather than to incorporate chelating metal salts. Where extended re-exposure to actinic radiation is not contemplated or where increasing background densities can be tolerated, the formazan dyes can be chelated and the photoreductant, the tetrazolium salt and the unreacted metal salt in the background areas can be left in the photographic element. In other words, processing after image formation can be omitted.

To form a radiation-sensitive composition useful in the present invention it is merely necessary to bring together the internal hydrogen source photoreductant and the tetrazolium salt. If desired, the labile hydrogen atoms incorporated within the photoreductant can be supplemented by hydrogen atoms supplied by an external hydrogen source compound. The radiation-sensitive composition can then be brought into a spacially fixed relationship, as by coating the composition onto a support to form a photographic element according to the present invention. For maximum efficiency of performance it is preferred that the components of the radiation-sensitive composition, particularly, the photoreductant, the tetrazolium salt and the external hydrogen source, if any, be intimately associated. This can be readily achieved, for example, by dissolving the reactants in a solvent system.

The solvent system can be a common solvent or a combination of miscible solvents which together bring all of the reactants into solution. Typical preferred solvents which can be used alone or in combination are lower alkanols, such as methanol, ethanol, isopropanol, t-butanol and the like; ketones, such as methylethyl ketone, acetone and the like; water; liquid hydrocarbons; chlorinated hydrocarbons, such as chloroform, ethylene chloride, carbon tetrachloride and the like; ethers, such as diethyl ether, tetrahydrofuran, and the like; acetonitrile; dimethyl sulfoxide and dimethyl formamide.

For ease of coating and for the purposes of imparting strength and resilience to the radiation-sensitive layer it is generally preferred to disperse the radiation-sensitive reactants in resinous polymer matrix or binder. A wide variety of polymers can be used as binders. In order to be useful it is only necessary that the binders be chemically compatible with the radiation-sensitive reactants. In addition to performing their function as a binder the polymers can also serve as external hydrogen sources to supplement or replace other hydrogen sources as described above. For example, any of the polymers set forth in Table II can be used both as binders and as external hydrogen sources.

It is preferred to employ linear film-forming polymers such as, for example, cellulose compounds, such as ethyl cellulose, butyl cellulose, cellulose acetate, cellulose triacetate, cellulose butyrate, cellulose acetate butyrate and the like; vinyl polymers, such as poly(vinyl acetate), poly(vinylidene chloride), a poly(vinyl acetal) such as poly(vinyl butyral), poly(vinyl chloride-co-vinyl acetate), polystyrene, and polymers of alkyl acrylates and methacrylates including copolymers incorporating acrylic or methacrylic acid; and polyesters, such as poly(ethylene glycol-co-isophthalic acid-co-terephthalic acid), poly(p-cyclohexane dicarboxylic acid-co-isophthalic acid-co-cyclohexylenebismethanol), poly(p-cyclohexanedicarboxylic acid-co-2,2,4,4-tetramethylcyclobutane-1,3-diol) and the like. The condensation product of epichlorohydrin and bisphenol is also a preferred useful binder. Generally any binder known to have utility in photographic elements and, particularly, diazo photographic elements can be used in the practice of this invention. These binders are well known to those skilled in the art so that no useful purpose would be served by including an extensive catalogue of representative binders in this specification. Any of the vehicles disclosed in *Product Licensing Index Vol.* 92, December 1971, publication 9232, at page 108, can be used as binders in the photographic elements of this invention.

While the proportions of the reactants forming the radiation-sensitive layer of a photographic element can be varied widely, it is generally preferred for most efficient utilization of the reactants that they be present in roughly stoichiometric concentrations--that is, equal molar concentrations. One or more of the reactants can, of course, be present in excess. For example, where the external hydrogen source is also used as a binder, it is typically present in a much greater concentration than is essential merely for donation of labile hydrogen atoms. It is generally preferred to incorporate from 0.1 to 10 moles of the tetrazolium salt per mole of the photoreductant. External hydrogen sources supplied solely to perform this function are typically conveniently incorporated in concentrations of from 0.5 to 10 moles per mole of photoreductant. Where a metal is added for the purpose of chelating the formazan dye, it is preferably incorporated in a proportion of from 0.1 to 10 moles per mole of tetrazolium salt. The binder can account for up to 99% by weight of the radiation-sensitive layer, but is typically employed in proportions of from 50 to 90% by weight of the radiation-sensitive layer. It is, of course, recognized that the binder can be omitted entirely from the radiation-sensitive layer. The surface or areal densities of the reactants can vary as a function of the formazan dyes formed and the image densities desired. It is generally preferred to incorporate the tetrazolium salt in a concentration of at least $1\times10^{-7}$ moles per square decimeter and, most preferably, in a concentration of from $1\times10^{-5}$ to $4\times10^{-5}$ moles per square decimeter. The areal densities of the remaining reactants are, of course, proportionate. Typically the radiation-sensitive layer can vary widely in thickness depending on the characteristics desired for the photographic element—e.g., image density, flexibility, transparency, etc. For most photographic applications coating thicknesses in the range of from 2 microns to 20 microns are preferred.

Any conventional photographic support can be used in the practice of this invention. Typical supports include transparent supports, such as film supports and glass supports as well as opaque supports, such as metal and photographic paper supports. The support can be either rigid or flexible. Preferred photographic supports for most applications are paper or film supports. The support can incorporate one or more subbing layers for the purpose of altering its surface properties. Typically subbing layers are employed to enhance the adherency of the radiation-sensitive coating to the support. Suitable exemplary supports are disclosed in *Product Licensing Index* Vol. 92, December 1971, publication 9232, at page 108.

The radiation-sensitive layer can be formed on the support using any conventional coating technique. Typically the reactants, the binder (if employed) and any other desired addenda are dissolved in a solvent system and coated onto the support by such means as whirler coating, brushing, doctor blade coating, hopper coating and the like. Thereafter the solvent is evaporated. Other exemplary coating procedures are set forth in the *Product Licensing Index* publication cited above, at page 109. Coating aids can be incorporated into the coating composition to facilitate coating as disclosed on page 108 of the *Product Licensing Index* publication. It is also possible to incorporate antistatic layers and/or matting agents as disclosed on this page of the *Product Licensing Index* publication.

It is a distinct advantage of this invention that the photographic elements can be processed in a dry state using commercially available exposure and processing equipment. Exposure to actinic radiation in the ultraviolet or visible portions of the spectrum can be readily achieved using mercury arc lamps, carbon arc lamps, photoflood lamps, lasers and the like. Negative images can be formed by exposure through a positive stencil or transparency while positive images can be formed by exposure through a negative stencil or transparency.

To avoid direct printout on exposure with the consequent necessity of fixing where uniform re-exposure to actinic radiation is contemplated, the radiation-sensitive layer is maintained significantly less basic than is required to convert the reducing agent precursor to the reducing agent. While the exact degree of permissible basicity of the radiation-sensitive layer will vary somewhat as a function of the specific reactants chosen, it is generally preferred to avoid the incorporation of strongly basic reactants in the radiation-sensitive layer. For this reason components of the radiation-sensitive layer are chosen to be free of strongly basic moieties. It is preferred, for maximum protection against premature and/or background printout, that the radiation-sensitive layer be maintained neutral or on the acid side of neutrality.

The latent image that is produced in the photographic element on exposure is easily developed using gaseous ammonia processors, such as those which release moist ammonia vapors at ambient pressure or those which use high pressure anhydrous ammonia gas. Other volatile bases, such as methyl amine, dimethyl amine, trimethyl amine, ethyl amine, diethyl amine, triethyl amine, propyl amine, butyl amine, etc., can be used. Although wet processing is not preferred, it is also contemplated that the photographic elements of this invention can be developed using aqueous alkaline solutions. It is contemplated that the radiation-sensitive layer or an adjacent layer of the photographic element can contain a base source which is convertible to a base at will. For example, it is contemplated that the radiation-sensitive layer can contain a compound that will release ammonia on exposure to heat or other activating energy.

Ligand Releasing Transition Metal Complexes as the Imaging Means

In one form the image recording means can be comprised of a transition metal complex capable of releasing ligands upon reduction of the transition metal present. As disclosed and claimed in commonly-assigned U.S. patent application Ser. No. 461,057 filed on Apr. 15, 1974 by Adin and Fleming entitled "Transition Metal Photoreduction Systems and Processes", one image recording means for generating an image through interaction with the photolysis product of an exposed photoreductant is a metal cobalt(III) complex which can be employed in combination with a material which responds to either released ligands, such as ammonia, or the cobalt(II) formed by reduction to form an image having a changed electromagnetic radiation absorption characteristic. The cobalt(III) complexes feature a molecule having a cobalt atom or ion surrounded by a group of atoms, ions or other molecules which are generically referred to as ligands. The cobalt atom or ion in the center of these complexes is a Lewis acid while the ligands are Lewis bases. While it is known that cobalt is capable of forming complexes in both its divalent and trivalent forms, trivalent cobalt complexes—i.e., cobalt(III) complexes—are employed in the practice of this invention, since the ligands are tenaciously held in these complexes as compared to corresponding cobalt(II) complexes. Preferred cobalt(III) complexes are those which are inert. Inert complexes are defined as those which, when a test sample thereof is dissolved at 0.1 molar concentration at 20° C. in an inert solvent solution also containing a 0.1 molar concentration of a tagged uncoordinated ligand of the same species as the coordinated ligand, exhibit essentially no exchange of uncoordinated and coordinated ligands for at least one minute, and preferably for at least several hours, such as up to five hours or more. This test is advantageously conducted under the conditions existing within the radiation-sensitive elements of this invention. Many cobalt(III)-complexes show essentially no change of uncoordinated or coordinated ligands for several days. The definition of inert complexes, and the method of measuring ligand exchange using radioactive isotopes to tag ligands are well known in the art. See, for example, Taube, *Chem. Rev.*, Vol. 50, p. 69 (1952) and Basolo and Pearson, *Mechanisms of Inorganic Reactions, A Study of Metal Complexes and Solutions*, 2nd Edition, 1967, published by John Wiley and Sons, page 141. Further details on measurement of ligand exchange appear in articles by Adamson et al, *J. Am. Chem.*, Vol. 73, p. 4789 (1951).

Preferred cobalt(III) complexes useful in the practice of this invention are those having a coordination number of 6. A wide variety of ligands can be used with cobalt(III) to form cobalt(III) complexes. Nearly all Lewis bases (i.e. substances having an unshared pair of electrons) can be ligands in cobalt(III) complexes. Some typical useful ligands include halides (e.g., chloride, bromide, fluoride), nitrate, nitrite, superoxide, water, amines (e.g., ethylenediamine, n-propylene diamine, diethylenetriamine, triethylenetetraamine, diaminodiacetate, ethylenediaminetetraacetic acid, etc.), ammine, azide, glyoximines, thiocyanate, cyanide, carbonate, and similar ligands, including those referred to on page 44 of Basolo et al, supra. It is also contemplated to employ cobalt(III) complexes incorporating as ligands Schiff bases, such as those disclosed in German OLS Pat. Nos. 2,052,197 and 2,052,198.

The cobalt(III) complexes useful in the practice of this invention are those which are free of sensitizable anions. In one form the cobalt(III) complex can be a neutral compound which is entirely free of either anions or cations. The cobalt(III) complexes can include one or more cations or nonsensitizable anions as determined by the charge neutralization rule. Useful cations are those which produce readily solubilizable cobalt(III) complexes, such as alkali and quaternary ammonium cations. Anions are considered to be sensitizable for purposes of this invention if their use in combination with known sensitizers for silver halide emulsions stimulates their photographic response upon exposure to electromagnetic radiation longer than 300 nanometers in wavelength. Such anions can, of course, be readily identified to be sensitizable by observing their behavior in combination with photolytically inactive cations with and without known spectral sensitizers being present. Especially useful with cobalt(III) complexes are nonsensitizable anions, such as halides (e.g., chloride, bromide, fluoride, etc.), sulfite, sulfate, alkyl or aryl sulfonates, nitrate, nitrite, perchlorate, carboxylates (e.g., halocarboxylates, acetate, hexanoate, etc.), hexafluorophosphate, tetrafluoroborate, as well as other, similar, nonsensitizable anions. Preferred cobalt(III) complexes are those which, in accordance with the charge neutralization rule, incorporate nonsensitizable anions having a net negative charge of 3.

In systems of the type disclosed by Thap Dominh in concurrently filed, commonly assigned patent application Ser. No. 461,172, filed on Apr. 15, 1974, titled HIGH GAIN TRANSITION METAL COMPLEX IMAGING, now abandoned, cobalt(III) complexes incorporating anions of acids having pKa values of 3.5 or less (preferably from 3.0 to 0.0), when employed with certain compounds containing conjugated $\pi$ bonding systems capable of forming Co(III) ligands, exhibit remarkable increases in imaging capabilities, probably due to catalytic production of the image.

Exemplary preferred cobalt(III) complexes useful in the practice of this invention are those set forth in Table VII.

TABLE VII

| Exemplary Preferred Cobalt(III)Complexes | |
|---|---|
| C-1 | hexa-ammine cobalt(III) acetate |
| C-2 | hexa-ammine cobalt(III) thiocyanate |
| C-3 | hexa-ammine cobalt(III) trifluoroacetate |
| C-4 | chloropenta-ammine cobalt(III) bromide |
| C-5 | bromopenta-ammine cobalt(III) bromide |
| C-6 | aquopenta-ammine cobalt(III) nitrite |
| C-7 | bis(ethylenediamine di-ammine cobalt-(III) perchlorate |
| C-8 | bis(ethylenediamine) diacetato cobalt-(III) chloride |
| C-9 | triethylenetetramine dichloro cobalt(III) acetate |
| C-10 | bis(methylamine) tetra-ammine cobalt(III) hexafluorophosphate |

TABLE VII-continued

| Exemplary Preferred Cobalt(III)Complexes | |
|---|---|
| C-11 | aquopenta(methylamine) cobalt(III) nitrate |
| C-12 | chloropenta(ethylamine) cobalt(III) chloride |
| C-13 | trinitrotris-ammine cobalt(III) |
| C-14 | trinitrotris(methylamine) cobalt(III) |
| C-15 | tris(ethylenediamine) cobalt(III) acetate |
| C-16 | tris(1,3-propanediamine) cobalt(III) tri-fluoroacetate |
| C-17 | bis(dimethylglyoxime) bispyridine cobalt-(III) trichloroacetate |
| C-18 | N,N'-ethylenebis(salicylideneimine) bis-ammine cobalt(III) bromide |
| C-19 | bis(dimethylglyoxime) ethylaquo cobalt-(III) |
| C-20 | μ-superoxodeca-ammine dicobalt(III) perchlorate |
| C-21 | sodium dichloro ethylenediamine diacetato cobalt(III) |
| C-22 | penta-ammine carbonato cobalt(III) nitrite |
| C-23 | tris(glycinato) cobalt(III) |
| C-24 | trans[bis(ethylenediamine) chlorothio-cyanato cobat(III)] sulfite |
| C-25 | trans[bis(ethylenediamine) diazido cobalt(III)] chloride |
| C-26 | cis[bis(ethylenediamine) ammine azido cobalt(III)]hexanoate |
| C-27 | tris(ethylenediamine) cobalt(III) chloride |
| C-28 | trans[bis(ethylenediamine) dichloro cobalt(III)] chloride |
| C-29 | bis(ethylenediamine) dithiocyanato cobalt(III) fluoride |
| C-30 | triethylenetetramine dinitro cobalt-(III) iodide |
| C-31 | tris(ethylenediamine) cobalt(III) 2-pyridylcarboxylate |

The reduction of these complexes by the photolysis product of the exposed photoreductant is stimulated by heating to an elevated temperature for a short period, such as is achieved by a passage of the element through a pair of rollers heated to 100° C. or higher. This develops or initiates the reduction, which produces an amine including $NH_3$ gas and Co(II) The image recording means can further include, as part of the recording layer, a material which reacts with either the amine or the Co(II). For example, the material can be such as to printout or bleach upon contact with ammonia, it can be dye-forming in the presence of ammonia, or it can form at least bidentate dye chelate with the cobalt. Considering the first of these, materials such as phthalaldehyde and ninhydrin printout upon contact with ammonia and are therefor useful in forming negative images. A number of dyes, such as certain types of cyanine dyes, styryl dyes, rhodamine dyes, azo dyes, etc. are known capable of being altered in color upon contact with a base. Particularly preferred for forming positive images are dyes which are bleached by contact with a base, such as ammonia, to a substantially transparent form. Pyrylium dyes have been found to be particularly suited for such applications. Representative examples of basic pH dye-forming materials include diazo salts mixed with couplers. Illustrative of suitable diazonium salts are such compounds as the salts of 1-diazo-2,5-dimethoxybenzene; 1-diazo-2,5-diethoxybenzene; 1-diazo-4-chloro-2,5-diethoxybenzene; 4-diazo-2,5-dimethoxybiphenyl; 4-diazo-2,5,4'-triethoxybiphenyl; 1-diazo-4-dimethylaminobenzene; 1-diazo-4-(diethylamino)benzene; 1-diazo-4-[bis(hydroxypropyl)amino]benzene; 1-diazo-4-(N-methyl-N-allylamino-benzene; 1-diazo-4-

(diamylamino)benzene; 1-diazo-4-(oxazolidino)benzene; 1-diazo-4-(cyclohexylamino)benzene; 1-diazo-4-(9-carbazolyl)benzene; 1-diazo-4-(dihydroxyethylamino)-3methylbenzene; 1-diazo-4-dimethylamino-3-methylbenzene; 1-diazo-2-methyl-4-(N-methyl-N-hydroxypropylamino)benzene; 1-diazo-4-dimethylamino-3-ethoxybenzene; 1-diazo-4-diethylamino-3-chlorobenzene; 1-diazo-2-carboxy-4-dimethylaminobenzene; 1-diazo-3-(2-hydroxyethoxy)-4-pyrrolidinobenzene; 1-diazo-2,5-diethoxy-4-acetoxyaminobenzene; 1-diazo-4-methylamino-3-ethoxy-6-chlorobenzene; 1-diazo-2,5-dichloro-4-benzylaminobenzene; 1-diazo-4-phenylaminobenzene; 1-diazo-4-morpholinobenzene; 1-diazo-4-morpholino-3-methoxybenzene; 1-diazo-4-morpholino-2,5-dimethoxybenzene; 1-diazo-4-morpholino-2,5-diethoxybenzene; 1-diazo-4-morpholino-2-ethoxy-5-methoxybenzene; 1-diazo-4-morpholino-2,5-dibutoxybenzene; 1-diazo-2,5-diethoxy-4-benzoylaminobenzene; 1-diazo-2,5-dibutoxy-4-benzoylaminobenzene; 1-diazo-4-ethylmercapto-2,5-diethoxybenzene; 1-diazo-4-tolylmercapto-2,5-diethoxybenzene and the like, as well as mixtures thereof.

Azo dye couplers which can be reacted with the diazonium salt to form an azo dye include a wide variety of chemical species such as those disclosed by Kosar, "Light-Sensitive Systems, "John Wiley & Sons, Inc., New York (1965), pp. 220–240.

Illustrative of suitable couplers are such compounds as for example, 2-hydroxy-3-naphthanilide; 2-hydroxy-2'-methyl-3-naphthanilide; 2-hydroxy-2',4'-dimethoxy-5'-chloro-3-naphthanilide; 2-hydroxy-2',4'-dimethoxy-3-naphthanilide; 2-hydroxy-2',5'-dimethoxy-4'-chloro-3-naphthanilide; 2-hydroxy-1'-naphthyl-3-naphthanilide; 2-hydroxy-2'-naphthyl-3-naphthanilide; 2-hydroxy-4'-chloro-3-naphthanilide; 2-hydroxy-2',5'-dimethoxy-3-naphthanilide; 2-hydroxy-2',4'-dimethyl-3-naphthanilide; 2,3-naphthalenediol; 1-hydroxy-2-naphthamide; N-methyl-1-hydroxy-2-naphthamide; N-butyl-1-hydroxy-2-naphthamide; N-octadecyl-1-hydroxy-2-naphthamide; N-phenyl-1-hydroxy-2-naphthamide; N-methyl-N-phenyl-1-hydroxy-2-naphthamide; N-(2-tetradecyloxyphenyl)-1-hydroxy-2-naphthamide; N-[4-(2,4-di-tert-pentylphenoxy)butyl]-1-hydroxy-2-naphthamide; 1-(1-hydroxy-2-naphthoyl)-piperidine; N-(3,5-dicarboxyphenyl)-N-ethyl-1-hydroxy-2-naphthamide; N,N-dibenzyl-1-hydroxy-2-naphthamide; N-(2-chlorophenyl)-1-hydroxy-2-naphthamide; N-(4-methoxyphenyl)-1-hydroxy-2-naphthamide; 1,3-bis(1-hydroxy-2-naphthamido)benzene; 2-acetamido-5-methylphenol; 2-acetamido-5-pentadecylphenyl; 2-butyramido-5-methylphenol; 2-(2,4-ditert-pentylphenoxyacetamido)-5-methylphenol; 2-benzamido-5-methylphenol and the like, as well as mixtures thereof.

Chelating agents for combining with the reduced Co(II) must be chemically compatible with the cobalt(III) complex and the photoreductant. Representative examples which produce optically dense Co(II) compounds to form negative images include formazan dyes, dithiooxamides, nitroso-arols, azo compounds, hydrazones, and Schiff bases. As is well understood by those skilled in the art all formazan dyes are capable of forming bidentate chelates and are therefore useful in the practice of this invention. Preferred formazan dyes are those having a ring-bonded, aromatic substituent in the 1 and 5 positions. In formazan dyes it is unnecessary that either of these aromatic substituents exhibit a ligand-forming capability in order for the dye to exhibit a bidentate chelateforming capability, but chelate ligand-forming, aromatic substituents can be chosen, if desired, to produce additional chelate ligands. Dithiooxamide is a preferred chelating compound as well as derivatives thereof having one or both nitrogen atoms substituted with an alkyl, alkaryl, aryl, or aralkyl group. Preferred nitroso-arol compounds are those in which the nitroso and hydroxy substituents are adjacent ring position substituents (e.g., 2-nitrosophenols, 1-nitroso-2-naphthols, 2-nitroso-1-naphthols, etc.). Preferred azo compounds capable of forming at least bidentate chelates with cobalt(II) are those of the general formula:

$$Z^1—N=N—Z^2.$$

Preferred hydrazones capable of forming at least bidentate chelates with cobalt(II) are those of the general formula:

$$Z^3—CH=N—NH—Z^4.$$

Preferred Schiff bases capable of forming at least bidentate chelates with cobalt(II) are those of the general formula:

$$Z^5—CH=N—Z^6.$$

In the foregoing formulas each of the Z substituents are chosen to be ring-bonded, aromatic substituents and at least $Z^2$, $Z^3$, $Z^4$, $Z^5$ and $Z^6$ are chosen to be capable of forming a chelate ligand. The aromatic substituents of the ligandforming compounds can take the form of either homocyclic or heterocyclic single- or multiple-ring substituents, such as phenyl, naphthyl, anthryl, pyridyl, quinolinyl, azolyl, etc. In one form the aromatic substituent can exhibit a ligand forming capability as a result of being substituted in the ring position adjacent the bonding position with a substituent which is susceptible to forming a ligand, such as a hydroxy, carboxy or amino group. In another form the aromatic substituent can be chosen to be an N-heterocyclic aromatic substituent which contains a ring nitrogen atom adjacent the azo bonding position—e.g., a 2-pyridyl, 2-quinolinyl, or 2-azolyl (e.g. 2-thiazolyl, 2-benzothiazolyl, 2-oxazolyl, 2-benzoxazolyl, etc.) substituent. The aromatic substituents can, of course, bear substituents which do not interfere with chelating, such as lower alkyl (i.e., one to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo, sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methylthio) substituents. It is generally preferred that the alkyl substituent moieties have 20 or fewer carbon atoms, most preferably six or fewer carbon atoms. The aryl substituents and substituent moieties are preferably phenyl or naphthyl groups. Exemplary preferred chelate-forming compounds are set forth in Table VIII.

TABLE VIII

| Exemplary Chelate-Forming Compounds | |
|---|---|
| CH-1 | 1,3,5-triphenylformazan |
| CH-2 | 1-(4-chlorophenyl)-3,5-diphenylformazan |
| CH-3 | 1-(4-iodophenyl)-3,5-diphenylformazan |
| CH-4 | 1,5-diphenylformazan |
| CH-5 | 1,5-diphenyl-3-methylformazan |
| CH-6 | 1,5-diphenyl-3-(3-iodophenyl)formazan |
| CH-7 | 1,5-(2-carboxyphenyl)-3-cyanoformazan |
| CH-8 | 1,5-diphenyl-3-acetylformazan |
| CH-9 | 1,3-diphenyl-5-(4-diphenyl)formazan |
| CH-10 | 1-(2-hydroxyphenyl)-3,5-diphenylformazan |
| CH-11 | 1-(2-carboxyphenyl)-3,5-diphenylformazan |
| CH-12 | 1-phenyl-3-(3,4-dimethoxyphenyl)-5-(4-nitrophenyl)formazan |
| CH-13 | 1,5-diphenyl-3-(2-naphthyl)formazan |
| CH-14 | 1-phenyl-3-undecyl-5-(4-nitrophenyl)-formazan |
| CH-15 | 1-(2-hydroxy-5-sulfophenyl)-3-phenyl-5-(2-carboxyphenyl)formazan |
| CH-16 | 1,5-diphenyl-3-carbohexoxyformazan |
| CH-17 | 1-(4-methylthiophenyl)-3-(3-nitrophenyl)-5-(3,5-dichlorophenyl)formazan |
| CH-18 | 1-(2-naphthyl)-3-(4-cyanophenyl)-5-(3-nitro-5-chlorphenyl)formazan |
| CH-19 | 1-(3-pyridyl)-3-(4-chlorophenyl)-5-phenylformazan |
| CH-20 | 1-(2,4,5-trichlorophenyl)-3-phenyl-5-(4-nitrophenyl)formazan |
| CH-21 | 1-(4-pyridyl)-3-phenyl-5-(2-trifluoromethylphenyl)formazan |
| CH-22 | 1-(2-nitro-4-chlorophenyl)-3-(4-chlorophenyl-5-(4-phenylazophenyl)formazan |
| CH-23 | 1,3-diphenyl-5-(2-pyridyl)formazan |
| CH-24 | 1-(2,5-dimethylphenyl)-3-phenyl-5-(2-pyridyl)formazan |
| CH-25 | 1-(2-pyridyl)-3-(4-cyanophenyl)-5-(2-tolyl)formazan |
| CH-26 | 1-(2-benzothiazolyl)-3-phenyl-5-(2-pyridyl)formazan |
| CH-27 | 1-(4,5-dimethylthiazol-3-yl)-3-(4-bromophenyl)-5-(3-trifluoromethylphenyl)formazan |
| CH-28 | 1,3-diphenyl-5-(benzothiazol-2-yl)-formazan |
| CH-29 | 1-(benzoxazol-2-yl)-3-phenyl-5-(4-chlorophenyl)formazan |
| CH-30 | 1,3-diphenyl-5-(2-quinolinyl)formazan |
| CH-31 | 1-phenylazo-2-phenol |
| CH-32 | 1-phenylazo-4-dimethylamino-2-phenol |
| CH-33 | 2-hydrophenylazo-2-phenol |
| CH-34 | 1-(2-hydroxyphenylazo)-2-naphthol |
| CH-35 | 1-(2-pyridylazo)-2-naphthol |
| CH-36 | 1-(2-pyridylazo)-2-phenol |
| CH-37 | 1-(2-pyridylazo)-4-resorcinol |
| CH-38 | 1-(2-quinolylazo)-2-naphthol |
| CH-39 | 1-(2-thiazolylazo)-2-naphthol |
| CH-40 | 1-(2-benzothiazolylazo)-2-naphthol |
| CH-41 | 1-(4-nitro-2-thiazolylazo)-2-naphthol |
| CH-42 | 1-(2-thiazolylazo)-4-resorcinol |
| CH-43 | 2,2-azodiphenol |
| CH-44 | 1-(3,4-dinitro-2-hydroxyphenylazo)-2,5-phenylene-diamine |
| CH-45 | 1-(2-benzothiazolylazo)-2-naphthol |
| CH-46 | 1-(1-isoquinolylazo)-2-naphthol |
| CH-47 | 2-pyridinecarboxaldehyde-2-pyridylhydrazone |
| CH-48 | 2-pyridinecarboxaldehyde-2-benzothiazolylhydrazone |
| CH-49 | 2-thiazolecarboxaldehyde-2-benzoxazolylhydrazone |
| CH-50 | 2-pyridinecarboxaldehyde-2-quinolylhydrazone |
| CH-51 | 1-(2-pyridinecarboxaldehyde-imino)-2-naphthol |
| CH-52 | 1-(2-quinolinecarboxaldehyde-imino)-2-naphthol |
| CH-53 | 1-(2-triazolecarboxaldehyde-imino)-2-naphthol |
| CH-54 | 1-(2-benzoxazolcarboxaldehyde-imino)-2-phenol |
| CH-55 | 1-(2-pyridine carboxaldehyde-imino)-2-phenol |

TABLE VIII-continued

| Exemplary Chelate-Forming Compounds | |
|---|---|
| CH-56 | 1-(2-pyridinecarboxaldehyde-imino)-2-pyridine |
| CH-57 | 1-(2-pyridinecarboxaldehyde-imino)-2-quinoline |
| CH-58 | 1-(4-nitro-2-pyridinecarboxaldehyde-imino)-2-thiazole |
| CH-59 | 1-(2-benoxazolecarboxaldehyde-imino)-2-oxazole |
| CH-60 | 1-nitroso-2-naphthol |
| CH-61 | 2-nitroso-1-naphthol |
| CH-62 | 1-nitroso-3,6-disulfo-2-naphthol |
| CH-63 | disodium 1-nitroso-2-naphthol-3,6-disulfonate |
| CH-64 | 4-nitrosoresorcinol |
| CH-65 | 2-nitroso-4-methoxyphenol |
| CH-66 | dithiooxamide |
| CH-67 | N,N'-dimethyldithiooxamide |
| CH-68 | N,N'-diphenyldithiooxamide |
| CH-69 | N,N'-di-n-hexyldithiooxamide |
| CH-70 | N,N'-di-p-tolyldithiooxamide |

To form a radiation-sensitive composition featuring the cobalt complex embodiment, it is merely necessary to bring together the photoreductant and the cobalt(III)complex. If required by the choice of photoreductant, an adjuvant should also be included. The radiation-sensitive composition can then be brought into a spacially fixed relationship, as by coating the composition onto a support to form a radiation-sensitive element according to the present invention. For maximum efficiency of performance it is preferred that the components of the radiation-sensitive composition, particularly, the photoreductant, the cobalt(III)complex and the adjuvant, if any, be intimately associated. This can be readily achieved, for example, by dissolving the reactants in a solvent system.

The processing of the ingredients to form the element is similar to that described for the previous embodiment. Thus, the solvent system can be a common solvent or a combination of miscible solvents which together bring all of the reactants into solution. Typical preferred solvents which can be used alone or in combination are lower alkanols, such as methanol, ethanol, isopropanol, t-butanol and the like; ketones, such as methylethyl ketone, acetone and the like; water; liquid hydrocarbons; chlorinated hydrocarbons, such as chloroform, ethylene chloride, carbon tetrachloride and the like; ethers, such as diethyl ether, tetrahydrofuran, and the like; acetonitrile; dimethyl sulfoxide and dimethyl formamide.

For ease of coating and for the purposes of imparting strength and resilience to the radiation-sensitive layer it is generally preferred to disperse the reactants in a resinous polymer matrix or binder. A wide variety of natural and synthetic polymers can be used as binders. In order to be useful it is only necessary that the binders be chemically compatible with the reactants. In addition to performing their function as a binder the polymers can also serve as adjuvants such as external hydrogen sources to supplement or replace other adjuvants such as hydrogen sources as described above. For example, any of the polymers set forth in Table II can be used both as binders and as external hydrogen sources. It is preferred to employ as the binder linear film-forming polymers such as those listed above in the discussion of the tetrazolium salt embodiment.

While the proportions of the reactants forming the radiation-sensitive layer can be varied widely, it is generally preferred for most efficient utilization of the reactants that they be present in roughly stoichiometric concentrations—that is, equal molar concentrations. One or more of the reactants can, of course, be present in excess. For example, where the external hydrogen source is also used as a binder, it is typically present in a much greater concentration than is essential merely for donation of labile hydrogen atoms. It is generally preferred to incorporate from 0.1 to 10 moles of the cobalt(III)complex per mole of the photoreductant. Adjuvants, such as external hydrogen sources, supplied solely to perform this function are typically conveniently incorporated in concentrations of from 0.5 to 10 moles per mole of photoreductant. The binder can account for up to 99% by weight of the radiation-sensitive layer, but is typically employed in proportions of from 50 to 90% by weight of the radiation-sensitive layer. It is, of course, recognized that the binder can be omitted entirely from the radiation-sensitive layer. The surface or areal densities of the reactants can vary, depending upon the specific application; however, it is generally preferred to incorporate the cobalt(III)complex in a concentration of at least $1\times10^{-7}$ moles per square decimeter. Thickness of coatings depend on desired characteristics, and preferably are between about 2 and about 20 microns.

In a simple form the image-recording element can consist of a support bearing thereon a coating including a material capable of either printout or bleachout upon contact with ammonia. As noted above, materials such as phthalaldehyde and ninhydrin printout upon contact with ammonia and are therefore useful in forming negative images. While the image-recording layer can consist essentially of a pH or ammonia responsive imaging material, in most instances it is desirable to include a binder for the imaging material. The image-recording element can be formed using the same support and binder materials employed in form the radiation-sensitive element or in any other convenient, conventional manner.

To record an image using separate radiation-sensitive and image-recording elements, the radiation-sensitive layer of the radiation-sensitive element is first imagewise exposed to radiation of from 300 to about 900 nm, preferably to radiation of from 300 to 700 nm. This can be accomplished using a mercury arc lamp, carbon arc lamp, photoflood lamp, laser or the like. Upon exposure to actinic radiation the photoreductant present in the radiation-sensitive layer is converted to a reducing agent in exposed areas and forms a redox couple with the cobalt(III)complex. Where a redox couple is formed that reacts rapidly at ambient temperatures, it is desirable to have the image-recording layer of the image-recording element closely associated with the radiation-sensitive layer at the time of exposure. Where the redox couple reacts more slowly, as in those instances where it is desirable to drive the redox reaction to completion with the application of heat, the image-recording element can be associated with the radiation-sensitive element before or after exposure. For example, in one form the radiation-sensitive element can be exposed and thereafter associated with the image-recording element, as by feeding the elements with the radiation-sensitive and image-recording layers juxtaposed between heated rolls. After the radiation-sensitive element has been used to produce an image in the image-recording element, it can be discarded or, where a more slowly reacting redox couple is formed, reused with another image-recording element to provide another photographic print.

TRIAZOLIUM SALTS AS THE IMAGING MEANS

As disclosed and claimed in commonly owned U.S. patent application Ser. No. 384,860 filed on Aug. 2, 1973 by D. S. Bailey and M. D. Shea, entitled TRIAZOLIUM SALT PHOTOREDUCTIVE IMAGING, now U.S. Pat. No. 3,880,659 another suitable image recording means for generating an image through interaction with the photolysis product of an exposed photoreductant is triazolium salts as a class. To be useful, the triazolium salt on reduction should form an azo-amine dye of a detectibly different color. A wide variety of such triazolium salts are known to the art including bis-triazolium salts linked directly or through intervening divalent radicals.

To be useful in the practice of this invention it is required only that the triazolium salt incorporated into the image-forming layer undergo detectable color change upon reduction to the corresponding dye. Since the azo-amine dyes exhibit higher optical densities than their parent triazolium salts, they produce a sharp visible contrast with background areas. It is a distinct advantage of this invention that triazolium salts are readily available in colorless form and tend to remain colorless in background areas during storage of the photographic elements. The transparency of the triazolium salts, of course, enhances the contrast that can be achieved both initially and after storage. Further, aesthetic considerations frequently dictate that white or transparent backgrounds be available for many photographic applications. Also of importance is that the azo-amine dyes produced by the triazolium salts of this invention can be chosen to provide any one of a wide variety of colors, and, most importantly, images of neutral hue can be formed by the azo-amine dyes. Hence, it is possible for the photographic elements of this invention to provide readily neutral hue images on transparent or white backgrounds, as is most desirable for many recording applications. Finally, the azo-amine dye images produced are generally more stable than comparable formazan dye images.

The triazolium salts preferred for the practice of this invention are those having an aroamatic ring fused with the triazole nucleus. Such triazolium salts produce azo-amine dyes of increased density as compared to triazolium salts lacking a fused aromatic ring. Further, these latter triazolium salts typiclly produce azo-amine dyes of a yellow hue, whereas triazolium salts containing an aromatic ring fused with the triazole nucleus are typically either shifted toward the red portion of the spectrum or more neutral in hue.

The triazolium salts which are most preferred for use in the practice of this invention are those which exist in the tautomeric forms indicated below:

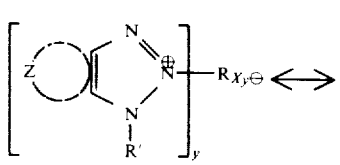

(A)

-continued

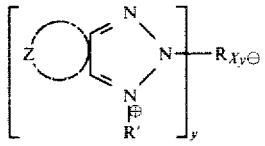

wherein Z is comprised of the atoms necessary to complete a fused, aromatic ring structure; y is 1 or 2; R is an aromatic or aromatic-like heterocyclic group; R′ is an aromatic substituent, an aromatic-like heterocyclic substituent or an alkyl group having from 1 to 20 carbon atoms, preferably 1 to 6 carbon atoms and X is an anion.

As employed herein the term "aromatic-like heterocyclic substituent" is defined as a substituent group including a 5 or 6 member ring structure having conjugated unsaturation and containing in addition to carbon atoms in the ring structure at least one atom selected from the group consisting of nitrogen, oxygen and sulfur. Exemplary of such aromatic-like heterocyclic substituents are pyridyl, oxazolyl, thiazolyl, quinolinyl, benzoxazolyl, benzothiazolyl and similar substituents.

In a specific preferred form of the invention Z is chosen to form a benzotriazole, naphtho[1,2-d]triazole or naphtho-[2,3-d]triazole nucleus. Generally triazolium salts containing naphthotriazole nuclei are preferred over those containing benzotriazole nuclei. When y is 2, R is preferably an arylene group—e.g., a phenylene, bisphenylene, naphthalene, anthrylene, etc. When y is 1, R is preferably an aryl group. R′ is preferably an aryl or aromatic-like heterocyclic group.

It is recognized that R, R′ and Z can include a variety of ring substituents. Exemplary of specifically contemplated ring substituents are lower alkyl (i.e., one to six carbon atoms), lower alkenyl (i.e., two to six carbon atoms), lower alkynyl (i.e., two to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyanide, azide, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxide (e.g., methylsulfoxide), sulfonium (e.g., dimethyl sulfonium), silane (e.g., trimethylsilane) and thioether (e.g., methyl mercaptide) substituents. While these and other substituents can be chosen to advantage to influence image densities, ease of reduction, dye color and stability, etc., the capability of a triazolium salt to be reduced to an azo-amine dye is in general controlled by the triazole nucleus configuration rather than the subtituents chosen. To enhance the stability of the azo-amine dyes produced it is preferred to incorporate within the triazolium salts of this invention predominantly electronegative substituents.

Any anion known to be useful in azo-amine dye forming triazolium salts can be used in the practice of this invention. Preferred anions are those set forth in Table IX. Any one of these anions can be incorporated in place of any other anion in any of the triazolium salts set forth in Table IX. Nonbasic, non-nucleophilic anions are preferred, such as tetrafluoroborate and hexafluorophosphate, for example. Such anions provide the resulting triazolium salt with enhanced protection against anion induced reduction, and for this reason their use is preferred.

It is recognized that the color of the azo-amine dyes can be influenced by the incorporation of various metal salts in combination with the triazolium salt. Salts of metals such as iron, nickel, cobalt, copper, zinc, cadmium, chromium, titanium, molybdenum or tungsten are useful for this purpose. It is also recognized that such metal salts can be used in the practice of this invention for the purpose of chelating the azo-amine dye produced on exposure to thereby further stabilize the dye against subsequent fading. All azo-amine dyes are capable of forming at least bidentate chelates. While distinct stabilization can be achieved with bidentate and tridentate chelates, the use of triazolium salts that form tridentate chelates gives greater stabilization and is preferred. Exemplary of triazolium salts capable of forming tridentate azo-amine dye chelates are those having one or more N-heterocyclic aromatic rings in the 1 or 2 position, such as 2-pyridyl and 2-azolyl (e.g., 2-thiazolyl, 2-benzothiazolyl, 2-oxazolyl, 2-benzoxazolyl, etc.) ring structures, for example.

If a metal salt is incorporated within the imaging layer for the purpose of chelating, some increase in background density can occur upon prolonged re-exposure to actinic radiation, unless the residual photoreductant, the remaining chelating metal salt, the unreduced triazolium salt or all of these are removed from the non-image areas. This can be accomplished, for example, by washing the photographic element in a suitable solvent, such as a polar solvent, like water, which does not attack or leach the azo-amine dye. To obtain minimal background densities and to avoid processing the photographic element after image formation, it is preferred to utilize triazolium salts with electronegative substituents that produce stabilized azo-amine dyes rather than to incorporate chelating metal salts. Where extended re-exposure to actinic radiation is not contemplated or where increasing background densities can be tolerated, the azo-amine dyes can be chelated and the photoreductant, the triazolium salt and the unreacted metal salt in the background areas can be left in the photographic element. In other words, processing after image formation can be omitted.

Exemplary preferred triazolium salts useful in the practice of this invention are set forth below in Table IX.

TABLE IX

| Exemplary Preferred Triazolium Salts for Forming Azo-Amine Dyes | |
|---|---|
| Tr-1 | 1-methyl-2-phenyl-2H-1,2,3-triazolium tetrafluoroborate |
| Tr-2 | 1-phenyl-2-(2-anilino-4-nitrophenyl-2H-1,2,3-triazolium fluorosulfonate |
| Tr-3 | 1-(n-propyl)-2-phenyl-2H-1,2,3-triazolium chloride |
| Tr-4 | 1-neopentyl-2-phenyl-2H-1,2,3-triazolium iodide |
| Tr-5 | 1-(2,4-dinitrophenyl)-2-phenyl-2H-1,2,3-triazolium fluorosulfonate |
| Tr-6 | 1-methyl-2-phenyl-5(or 6)-nitro-2H-benzo-1,2,3-triazolium hexafluorophosphate |
| Tr-7 | 1-(n-butyl)-2-phenyl-6-nitro-2H-benzo-1,2,3-triazolium iodide |
| Tr-8 | 2,3-diphenyl-2H-naphtho[1,2-d]-1,2,3-triazolium tetrafluoroborate |
| Tr-9 | 2-phenyl-3-(n-hexyl)-2H-naphtho[1,2-d]-1,2,3-triazolium iodide |
| Tr-10 | 2-phenyl-3-(pyrid-2-yl)-2H-naphtho- |

TABLE IX-continued

| | Exemplary Preferred Triazolium Salts for Forming Azo-Amine Dyes |
|---|---|
| | [1,2-d]-1,2,3-triazolium perchlorate |
| Tr-11 | 2-(3-chlorophenyl)-3-phenyl-2H-naphtho-[1,2-d]-1,2,3-triazolium perchlorate |
| Tr-12 | 2-(2-trifluoromethylphenyl)-3-phenyl-2H-naphtho[1,2-d]1,2,3-triazolium tetrafluoroborate |
| Tr-13 | 2-(4-carbomethoxyphenyl)-3-phenyl-2H-naphtho[1,2-d]-1,2,3-triazolium hexafluorophosphate |
| Tr-14 | di]2-(2,3,4,5-tetrachlorophenyl)-3-phenyl-2H-naphtho[1,2-d]-1,2,3-triazolium] tetrachlorozincate |
| Tr-15 | 2-(4-fluoro-4-biphenyl)-3-phenyl-2H-naphtho[1,2-d]1,2,3-triazolium chloride |
| Tr-16 | 2-(4-cyano-1-naphthyl)-3-phenyl-2H-naphtho[1,2,-d]-1,2,3-triazolium bormide |
| Tr-17 | 2-(4-nitrophenyl)-3-phenyl-2H-nahptho-[1,2-d]-1,2,3-trazolium tetrafluoroborate |
| Tr-18 | 2-(2,4-dinitrophenyl)-3-phenyl-2H-naphtho[1,2-d]-1,2,3-triazolium tetrafluoroborate |
| Tr-19 | 2-(1-nitro-2-naphthyl)-3-phenyl-2H-naphtho[1,2-d]-1,2,3-triazolium tetrafluoroborate |
| Tr-20 | 2-[2-(9,10-anthroquinolyl)]-3-phenyl-2H-naphtho[1,2-d]',2,3-triazolium bromide |
| Tr-21 | 2-(4-methoxyphenyl)-3-phenyl-2H-naphtho-[1,2-d]-1,2,3-triazolium tetrafluoroborate |
| Tr-22 | 2,3-diphenyl-2H-(5-phenoxynaphtho[ 1,2-d])-1,2,3-triazolium nitrate |
| Tr-23 | 2-phenyl-3-(4-thiomethylphenyl)-2H-naphtho[1,2-d]-1,2,3-triazolium chloride |
| Tr-24 | 2-phenyl-3(2-fluorophenyl)-2H-(7,8-dimethylnaphtho[1,2-d]-1,2,3-triazolium hexafluorophosphate |
| Tr-25 | 2,2'-(p-phenylene)-bis(3-phenyl)-2H-naphtho[1,2-d]-1,2,3-triazolium hexafluoro-phoshate |
| Tr-26 | 2,3'-(2-methyl-1,4-phenylene)-bis-(3-phenyl-2H-naphtho[1,2-d]-1,2,3-triazolium hexafluorophosphate |
| Tr-27 | 2,2'-(p-phenylene)-bis-(3-benzothiazol-2-yl-2H-naphtho[1,2-d]-1,2,3-triazolium hexafluorophosphate |
| Tr-28 | 2,2-'-(2-chloro-1,4-phenylene)-bis-(3-phenyl-2H-naphtho[1,2-d]-1,2,3-triazolium hexafluorophosphate |
| Tr-29 | 2,2'-(4,4'-biphenylene)-bis-(3-phenyl-2H-naphtho[1,2-d]1,2,3-triazolium hexafluorophosphate) |
| Tr-30 | 2,2'-(3,3'-dimethoxy-4,4'-biphenylene)-bis-(3-phenyl-2H-naphtho[1,2-d]1,2,3-triazolium hexafluorophosphate) |
| Tr-31 | 2,2'-(1,5-naphthylene)-bis-(3-phenyl-2H-naphtho[1,2-d]-1,2,3-triazolium hexafluorophosphate) |
| Tr-32 | 2,2'-[1,5-(9,10-anthroquinolyl(]-bis-(3-phenyl-2H-naphtho[1,2-d]-1,2,3-triazolium tetrafluoroborate) |
| Tr-33 | 2-(4-methoxyphenyl)-3-phenyl-2H-naphtho-[1,2-d]-1,2,3-triazolium bromide |
| Tr-34 | 2,3-di(4-methoxyphenyl)-5-nitro-2H-naphtho[1,2-d]-1,2,3-triazolium bromide |
| Tr-35 | 2,3-di(4-chlorophenyl)-5-methoxy-2H-naphtho[1,2-d]1,2,3-triazolium perchlorate |
| Tr-36 | 2-(3-trifluoromethylphenyl)-6,9-dibromo-2H-naphtho[1,2-d]-1,2,3-triazolium tetra-fluoroborate |

Procedures for preparing triazolium salts useful in the practice of this invention are known in the art. Exemplary of known preparative techniques are those disclosed by Krollpfeiffer, Mulhausen and Wolf, *Annalen*, 508, 30, (1933); Begtrup and Poulsen, *Acta Chem. Scand.* 25,2096 (1971); and Charrier and Beretta, *Gazzetta Chimica Italiana*, 53, 773 (1923).

The preparation of the element is essentially the same as in the case of the tetrazolium salt imaging means. Development is also the same, that is, by ammonia.

OTHER IMAGE RECORDING MEANS

Still other image recording means are operative with internal hydrogen source quinones, and to a degree which is superior to that obtainable with photoreductants, such as quinones, which lack the internal hydrogen source. Preferred examples are silver salts of organic acids, bleachable dyes, leuco phthalocyanine dyes, and a salt or complex of a disproportionable metal. Regardless of the image recording means used, the binder, preparation of the dope, and application of the coating proceeds essentially as described above for the preceding embodiments. The processing or developing of the element so prepared can be achieved by heating or by exposure to gaseous ammonia, as hereinafter noted. In the case of bleachable dyes, the development proceeds automatically.

Considering first the silver salt, preferred examples include the silver salts of carboxylates, such as silver acetates, for example silver trifluoroacetate, and silver difluoroacetate; and for example silver heptafluorobutyrate, silver tetrafluoroborate and silver hexafluorophosphate. The invention also contemplates the use of silver salts of fluorinated alkanesulfonic acids such as $CF_3CHFCF_2SO_3Ag$ disclosed in the aforesaid U.S. Pat. No. 3,529,963. The dope is prepared from a suitable binder such as a butyrate, and a solvent such as methanol. Development is preferably by heat, such as pressing the element under a heated pressure member.

A positive image can be directly produced by the elimination, such as by bleaching, of an optically dense dye when it is reduced by the reducing agent formed by the imagewise irradiation of the photoreductant. Preferred dyes for the embodiment include thionin, methylene blue, azure A, azure B, azure C, brilliant cresyl blue and toluidine blue O. The reducing agent is apparently immediately formed upon exposure, as the dye is imagewise bleached without the necessity for a subsequent development step such as heating. In contrast, when a photoreductant not having internal hydrogen sources, such as 1,4-naphthoquinone, is substituted for the internal hydrogen source quinones, insufficient image is produced resulting from insufficient bleaching of the dye.

Considering the leuco phthalocyanine dye embodiment, a negative image can be produced by combining the internal hydrogen source quinone with a colorless phthalocyanine dye capable of reduction to a visible dye by the reducing agent generated from the quinone. Preferred leuco phthalocyanine dyes include metallic leucophthalocyanine dyes, wherein the metallic atom is nickel or copper. Other dyes are also contemplated. That is, the action of the reducing agent in forming the dye is considered to be unaffected if additional halide radicals are added on the periphery of the "wings" of the dye. After imagewise exposure of the photographic element, the reducing agent can be developed from the photoinitiated precursor either by processing the element in gaseous ammonia as disclosed above in the tetrazolium salt embodiment, or by thermal development as described above in connection with the cobalt(III)complex imaging means. Upon reduction, copper leucophthalocyanine, for example, forms the blue copper phthalocyanine dye. As with the previous embodiments, a marked improvement can be seen in the use of quinones having the internal hydrogen sources in that the required exposure time to produce the desired image is greatly reduced.

Other embodiments contemplated within the invention include a salt or complex of a disproporionable metal as the image recording means. As in the aforedescribed embodiments, the preferred internal hydrogen source quinones form a reducing agent when imagewise exposed, which agent is capable of reducing the metal salt to form an image. Suitable examples of such metal salts can be found for example in U.S. Pat. No. 3,700,448.

EXAMPLES

This invention is further illustrated by the following examples of preferred embodiments:

Tetrazolium Salts

EXAMPLE 1

A mixture was prepared by dissolving the following components in an ethylene chloride-methanol solvent blend of 9.0 and 2.5 cc of respective solvents:

| | |
|---|---|
| 2-(1-hydroxyethyl)-5-methyl-1,4-benzoquinone (PR-27) | 1.0 mmole |
| 2-(4-iodophenyl)-3-(4-nitrophenyl)-5-phenyl-2H-tetrazolium chloride (T-74) | 1.0 mmole |
| styrene-butadiene random copolymer consisting essentioally of 78% by weight styrene and 22% by weight butadiene (sold commercially under the trademark KRO-3 by Phillips Petroleum) | 1.0 g |

A coating of approximately 100 microns wet thickness of the mixture was formed on a poly(ethylene terephthalate) film support and samples were exposed for 8 seconds through a step tablet and developed in a commercial diazo ammonia processor. Intense red negative prints were obtained with an average initial density to green light of 1.77. The results are included in Table X.

EXAMPLES 2 THROUGH 54

Each coating was made up by mixing 1.00 millimole of the tetrazolium salt with 1.00 millimole of the photoreductant and 0.660 g. of cellulose acetate butyrate binder. While the binder was capable of functioning to a limited degree as an external hydrogen source of hydrogen donor, the binder is not designated as a hydrogen source in Table X, since its contribution as a hydrogen source was in this instance negligible. In some of the coatings, as designated in Table X, the highly efficient external hydrogen source HS-2 was incorporated in a concentration of 1.00 millimole. In others of the coatings no efficient external hydrogen source was present in combination with the internal hydrogen source photoreductant. This is designated in Table X by the designation "Internal." In each instance the radiation-sensitive layer was coated onto a transparent film support from a solution formed with 11.5 cc. of a solvent. Two solvent systems were used. One solvent system was a mixture of 1.4 parts by volume ethylene chloride per part by volume of methanol. In the other solvent system 3.6 parts of acetone were present per part by volume of methanol. The radiation-sensitive coatings were in each instance 100 microns in thickness as coated.

Processing was accomplished by a 30 second exposure through a neutral density step tablet in an exposing unit of the type commercially available under the trademark Filmsort Uniprinter 086. Immediately after exposure the photographic elements were given three passes through a Keuffel and Esser Mercury Ammonia Chamber. In Example 24 the fully processed photographic element was uniformly re-exposed to actinic radiation in the exposure unit and then viewed for background printout. No background printout was visible to the eye.

TABLE X

Exemplary Image and Background Qualities Produced by Various Photoreductants and Hydrogen Sources

| Ex. # | T-Salt | Photo-Reductant | Hydrogen Donor | Green Density Max. | Green Density Min. |
|---|---|---|---|---|---|
| 1 | T-74 | PR-27 | Internal only | 1.77 | N.R. |
| 2 | T-1 | PR-2 | Internal | 1.60 | 0.62 |
| 3 | T-1 | PR-3 | Internal | 1.05 | 0.95 |
| 4 | T-1 | PR-4 | Internal | 1.07 | 0.06 |
| 5 | T-74 | PR-4 | Internal | 1.60 | 0.06 |
| 6 | T-1 | PR-8 | Internal | 1.01 | 0.04 |
| 7 | T-1 | PR-11 | Internal | 0.92 | 0.04 |
| 8 | T-1 | PR-12 | Internal | 1.50 | 0.05 |
| 9 | T-1 | PR-12 | HS-2/Int. | 1.54 | N.R. |
| 10 | T-1 | PR-13 | Internal | 1.01 | 0.08 |
| 11 | T-1 | PR-15 | Internal | 1.48 | 0.06 |
| 12 | T-1 | PR-16 | Internal | 1.40 | 0.07 |
| 13 | T-1 | PR-17 | HS-2/Int. | 1.77 | N.R. |
| 14 | T-1 | PR-17 | Internal | 1.82 | 0.08 |
| 15 | T-74 | PR-17 | Internal | 2.63 | 0.05 |
| 16 | T-1 | PR-19 | Internal | 1.90 | 0.06 |
| 17 | T-74 | PR-20 | Internal | 1.00 | 0.12 |
| 18 | T-74 | PR-22 | Internal | 0.70 | 0.05 |
| 19 | T-74 | PR-22 | Internal | 3.97 | 0.51 |
| 20 | T-1 | PR-23 | Internal | 1.01 | 0.05 |
| 21 | T-74 | PR-23 | Internal | 3.00 | 0.04 |
| 22 | T-74 | PR-24 | Internal | 2.51 | 0.34 |
| 23 | T-74 | PR-26 | Internal | 2.59 | 0.06 |
| 24 | T-74 | PR-27 | Internal | 3.42 | 0.13 |
| 25 | T-74 | PR-28 | internal | 3.22 | 0.10 |
| 26 | T-74 | PR-29 | Internal | 1.87 | 0.17 |
| 27 | T-24 | PR-30 | Internal | 1.86 | 0.06 |
| 28 | T-74 | PR-30 | Internal | 2.66 | 0.10 |
| 29 | T-74 | PR-33 | Internal | 2.12 | 0.06 |
| 30 | T-74 | PR-34 | Internal | 1.86 | 0.00 |
| 31 | T-74 | PR-36 | Internal | 1.66 | 0.05 |
| 32 | T-1 | PR-39 | Internal | 0.90 | 0.06 |
| 33 | T-1 | PR-39 | HS-2/Int. | 0.99 | 0.06 |
| 34 | T-74 | PR-42 | Internal | 1.42 | 0.06 |
| 35 | T-1 | PR-44 | Internal | 1.30 | 0.06 |
| 36 | T-1 | PR-44 | HS-2/Int. | 1.30 | 0.06 |
| 37 | T-1 | PR-45 | Internal | 1.33 | 0.07 |
| 38 | T-1 | PR-47 | Internal | 1.21 | 0.06 |
| 39 | T-1 | PR-48 | Internal | 1.04 | 0.06 |
| 40 | T-1 | PR-53 | Internal | 1.28 | 0.08 |
| 41 | T-1 | PR-54 | Internal | 1.44 | 0.05 |
| 42 | T-1 | PR-54 | Internal | 1.39 | 0.05 |
| 43 | T-1 | PR-45 | HS-2/Int | 1.44 | 0.06 |
| 44 | T-1 | PR-60 | Internal | 1.19 | 0.07 |
| 45 | T-1 | PR-62 | Internal | 2.67 | 0.09 |
| 46 | T-1 | PR-63 | Internal | 2.00 | 0.20 |
| 47 | T-1 | PR-64 | Internal | 2.31 | 0.20 |
| 48 | T-1 | PR-65 | Internal | 2.79 | 0.09 |
| 49 | T-1 | PR-66 | Internal | 3.07 | 0.20 |
| 50 | T-1 | PR-67 | Internal | 2.91 | 0.05 |
| 51 | T-1 | PR-68 | Internal | 3.00 | 0.10 |
| 52 | T-1 | PR-69 | Internal | 3.20 | 0.13 |
| 53 | T-1 | PR-71 | Internal | 1.65 | 0.05 |
| 54 | T-74 | PR-71 | Internal | 2.40 | 0.05 |

N.R. = No record was kept which could be located for inclusion in this table.

EXAMPLES 55 THROUGH 87

A mixture was prepared in each instance using 65 g. of acetonitrile, 25 g. of methanol, 10 g. of cellulose acetate butyrate binder and either 7.5 millimoles of 2-(1-hydroxyethyl)-5-methyl-1,4-benzoquinone (PR-27) or 2-isopropoxy-1,4-naphthoquinone (PR-54). To 6 grams of this mixture was added a tetrazolium salt. Those mixtures containing PR-27 received 0.2 millimoles of tetrazolium salt and those containing PR-54 received 0.4 millimoles of tetrazolium salt. The mixture was agitated and coated with a 150 micron coating blade onto a 100 micron poly(ethylene terephthalate) film support. Contact exposure for 8 seconds on an exposing unit commercially available under the trademark IBM Microcopier II was followed by development with anhydrous ammonia at 75 psi. At this point the initial image densities to green light were measured. These are set out in Table XI.

The developed images were placed on a desk top in a room lighted by two banks of three GE F400W Cool White fluorescent lights six and eight feet from the desk surface. The half-life reported in Table XI is the time elapsed before the dye had irreversibly faded to destroy one half of the formazan dye initially present.

TABLE XI

Exemplary Image Qualities Produced by Various Tetrazolium Salts

| Ex. # | T-Salt | Photo-Reductant | Summed Substituent Sigma Values | Initial Image Green Density | Half-life (days) |
|---|---|---|---|---|---|
| 55 | T-1 | PR-54 | 0.0 | 1.7 | 8 |
| 56 | T-2 | PR-54 | −0.13 | 1.8 | 10 |
| 57 | T-3 | PR-54 | +0.24 | 2.1 | 12 |
| 58 | T-4 | PR-54 | +0.24 | 1.7 | 12 |
| 59 | T-5 | PR-54 | +0.30 | 1.9 | 9 |
| 60 | T-8 | PR-54 | +0.24 | 1.8 | 12 |
| 61 | T-16 | PR-54 | +0.24 | 0.7 | 21 |
| 62 | T-31 | PR-27 | +0.72 | 1.9 | 3 |
| 63 | T-33 | PR-54 | +0.71 | 2.0 | N.R. |
| 64 | T-34 | PR-27 | +0.71 | 1.5 | 5 |
| 65 | T-34 | PR-54 | +0.71 | 1.5 | 25 |
| 66 | T-35 | PR-27 | +0.78 | 0.5 | 6 |
| 67 | T-35 | PR-54 | +0.78 | 1.5 | 21 |
| 68 | T-83 | PR-27 | +0.48 | 2.2 | 90 |
| 69 | T-71 | PR-27 | >1.05 | 2.3 | 145 |
| 70 | T-71 | PR-54 | >1.05 | 1.6 | 150 |
| 71 | T-84 | PR-27 | >0.78 | 1.6 | 90 |
| 72 | T-84 | PR-54 | >0.78 | 1.5 | 80 |
| 73 | T-85 | PR-27 | >1.02 | 2.8 | 80 |
| 74 | T-85 | PR-54 | >1.02 | 2.0 | 100 |
| 75 | T-86 | PR-27 | +0.95 | 1.9 | 80 |
| 76 | T-86 | PR-54 | +0.95 | 1.7 | 86 |
| 77 | T-87 | PR-27 | >1.56 | N.R. | 180 |
| 78 | T-89 | PR-27 | >0.65 | 2.7 | 18 |
| 79 | T-90 | PR-27 | >0.78 | 3.0 | 8 |
| 80 | T-90 | PR-54 | >0.78 | 2.2 | 33 |
| 81 | T-91 | PR-27 | >1.08 | 3.7 | 12 |
| 82 | T-91 | PR-54 | >1.08 | 2.0 | N.R. |
| 83 | T-92 | PR-27 | >1.02 | 2.6 | 17 |
| 84 | T-93 | PR-27 | >1.56 | 3.9 | 20 |
| 85 | T-93 | PR-54 | >1.56 | 2.0 | N.R. |
| 86 | T-94 | PR-27 | >1.56 | 2.4 | 21 |
| 87 | T-95 | PR-27 | +1.40 | 2.5 | 13 |

EXAMPLES 88 THROUGH 92

In 7 gram portions of a mixture containing 6.6 g. cellulose acetate butyrate, 90 cc ethylene chloride, 25 ml methanol and 0.70 g. of 1-(2-pyridyl)-3-phenyl-5-(2,6-dimethylphenyl)formazan was dissolved 0.12 millimoles of a metal acid complex. In one portion used as a control no metal acid complex was dissolved. Since the intention was to compare the fade characteristics of a formazan dye and tridentate chelates of this dye, it was considered unnecessary to produce the formazan dye in situ by the process of this invention. The formazan dye could, of course, have been formed from the tetrazolium salt T-100 according to the practice of this invention.

The mixture was coated at 100 microns wet thickness onto a support. Since the dye was already formed it was unnecessary to expose the elements and then develop them. The wavelength of peak adsorption (λ max) and the image density were noted for each element. Each coating was then subjected to 500 foot-candles from a xenon arc for 24 hours. At the end of this period the image density of the coating was again determined and compared to the original image density. This is reported in Table XII as the percentage of fade. The metal acid complexes used for chelating are also set out in Table XII.

TABLE XII

Exemplary Metal Chelated Formazan Dye Stabilites

| Ex. # | Metal Acid Complex | λmax | % Fade |
|---|---|---|---|
| 88 | None | 460 | 8.5 |
| 89 | Mercury Acetate | 485 | 7.0 |
| 90 | Nickel Cyclohexylbutyrate | 582 | 0.0 |
| 91 | Copper Cyclohexylbutyrate | 590 | 0.0 |
| 92 | Cobalt Cyclohexylbutyrate | 665 | 0.0 |

EXAMPLES 93 THROUGH 110

In each instance a solution was prepared containing 1.25 ml methanol, 4.5 ml ethylene chloride, 0.33 g. of cellulose acetate butyrate, 0.25 millimoles of a tetrazolium salt, 0.28 millimoles of a metal acid complex and 0.10 g. 2-isopropoxy-1,4-naphthoquinone (PR-54). This solution was coated with a 100 micron coating blade on a 100 micron poly(ethylene terephthalate) film support. Each element was given a contact exposure through a 0.05 neutral density filter for 10 seconds on a commercial exposure unit sold under the trademark Filmsort Uniprinter 086 followed by development in a Keuffel and Esser Mercury Ammonia Chamber. The resulting blue, green and red image densities for the various elements are set out in Table XIII.

TABLE XIII

EXEMPLARY RED, GREEN AND BLUE DENSITIES FOR CHELATED FORMAZAN DYE IMAGES

| Ex # | T-salt | Metal Acid Complex | DB | DG | DR |
|---|---|---|---|---|---|
| 93 | T-102 | Nickel Cyclohexyl-butyrate | N.R. | N.R. | 1.02 |
| 94 | T-101 | Nickel Cyclohexyl-butyrate | 0.54 | 1.27 | 2.15 |
| 95 | T-101 | Zinc Acetate | 0.65 | 0.63 | 0.75 |
| 96 | T-101 | None | 0.84 | 0.20 | N.R. |
| 97 | T-111 | Nickel Cyclohexyl-butyrate | 0.63 | 0.90 | 1.99 |
| 98 | T-111 | Zinc Acetate | 0.63 | 0.78 | 1.69 |
| 99 | T-111 | Copper Cyclohexyl-butyrate | 0.61 | 0.68 | 1.65 |
| 100 | T-111 | None | 1.27 | 0.48 | 0.05 |
| 101 | T-100 | Nickel Cyclohexyl-butyrate | 0.65 | 0.90 | 0.71 |
| 102 | T-100 | Copper Cyclohexyl-butyrate | 0.92 | 0.80 | 0.78 |
| 103 | T-100 | None | 1.29 | 0.34 | 0.08 |
| 104 | T-103 | Nickel Cyclohexyl-butyrate | 0.60 | 0.60 | 1.12 |
| 105 | T-103 | Nickel Cyclohexyl-butyrate | 0.80 | 1.22 | |
| 106 | T-103 | Zinc Cyclohexyl-butyrate | 0.80 | 0.86 | 1.46 |
| 107 | T-103 | Cadmium Cyclohexyl-butyrate | 1.07 | 0.94 | 1.46 |
| 108 | T-103 | None | 1.16 | 0.70 | 0.08 |
| 109 | T-104 | Cadmium Nitrate | N.R. | N.R. | 1.14 |

TABLE XIII-continued

| EXEMPLARY RED, GREEN AND BLUE DENSITIES FOR CHELATED FORMAZAN DYE IMAGES | | | | | |
|---|---|---|---|---|---|
| Ex # | T-salt | Metal Acid Complex | DB | DG | DR |
| 110 | T-104 | None | 1.06 | N.R. | N.R. |

EXAMPLES 111 THROUGH 113

In a 5.5 g. portion of a mixture containing 10 g. cellulose acetate butyrate, 70 g. methyl ethyl ketone, 20 g. of methanol and 1.23 g. of 2-(1-hydroxyethyl)-5-methyl-1,4-benzoquinone (PR-27) was dissolved 0.25 millimoles of 2-(4-iodophenyl)-3-(4-nitrophenyl)-5-phenyl tetrazolium tetrafluoroborate and 0.99 g. of copper cyclohexylbutyrate. The mixture was coated with a 150 micron coating blade. The initial neutral density after an 8 second exposure on an exposure unit commercially available under the trademark IBM Microcopier II and 1 second ammonia development at 75 psi was 1.62. These results are summarized below in Table XIV. Similar runs with different tetrazolium salts are also set out in Table XIV.

TABLE XIV

| Exemplary Densities of Elements Incorporating Bidentate Formazans | | | |
|---|---|---|---|
| Ex. # | T-Salt | Area | Neutral Density |
| 111 | T-91 | Image | 1.62 |
| | | Background | 0.07 |
| 112 | T-87 | Image | 1.12 |
| | | Background | 0.07 |
| 113 | T-93 | Image | 2.17 |
| | | Background | 0.09 |

EXAMPLES 114 THROUGH 124

To provide a direct comparison of the performance of internal hydrogen source quinones and external hydrogen source quinones, the procedure of Examples 2 through 54 was repeated substituting external hydrogen source quinones as photoreductants. The results summarized in Table XV, when compared with those of Table X, show that significantly higher maximum green image densities and image to background contrasts are obtained with the internal hydrogen source quinones. The binder was the only available external hydrogen source.

TABLE XV

| Exemplary Image and Background Densities Produced by External Hydrogen Source Quinones | | | | |
|---|---|---|---|---|
| | | | Green Density | |
| Ex. #1 | T-Salt | External hydrogen Source Quinone | Max. | Min. |
| 114 | T-74 | 2,5-Dimethyl-1,4-benzoquinone | 0.42 | 0.06 |
| 115 | T-74 | Phenanthrenequinone | 0.48 | 0.09 |
| 116 | T-74 | Duroquinone | 0.32 | 0.06 |
| 118 | T-74 | 2,3,5-Trimethyl-6-bromo-1,4-benzoquinone | | |
| 119 | T-74 | 1,4-Naphthoquinone | 1.06 | 0.46 |
| 120 | T-74 | 2-Methyl-1,4-naphthoquinone | 0.65 | 0.05 |
| 121 | T-1 | 2-Methyl-1,4-naphthoquinone | 0.55 | 0.06 |
| 122 | T-74 | 2,3-Dimethyl-1,4-naphthoquinone | 0.29 | 0.05 |
| 123 | T-1 | 2-Thiomethyl-1,4-naphthoquinone | 0.37 | 0.07 |
| 124 | T-1 | 2-(Acetylthiomethyl)-3-methyl-1,4-naphthoquinone | 0.75 | 0.40 |

EXAMPLE 125

A coating was prepared as described in Examples 2 through 54 using 2,3,5-triphenyl-2H-tetrazolium chloride (T-1) as the tetrazolium salt and 2-nitrobenzyl alcohol as the photoreductant. Contact exposure for 8 seconds on an exposing unit commercially available under the trademark IBM Microcopier II was followed by development for one second with anhydrous ammonia at 75 psi. A negative reddish image was produced on a colorless background.

EXAMPLE 126

A coating was made up by mixing 6 grams of cellulose acetate butyrate (used as a binder), 36 grams of acetone, 12 grams of methanol, 6 grams of methoxyethanol and 0.90 grams of phenyl-1,2-ethanediol (HS-2). In 6 grams of this mixture were dissolved 0.164 grams of 2-nitrobenzyl alcohol and 0.196 grams of 2-(2,5-dichlorophenyl)-3-(2-methoxy-4-nitrophenyl)-5-(4-methoxyphenyl-2H-tetrazolium tetrafluoroborate (T-67). A coating was prepared on polyethylene terephthalate film support with a wet coating thickness of approximately 150 microns. Contact exposure for 8 seconds on an exposing unit commercially available under the trademark IBM Microcopier II was followed by development for one second with anhydrous ammonia at 75 psi. A negative purple image was obtained having an initial maximum density to green light of 1.02. The background areas exhibited a green density of 0.10.

In each of the foregoing examples the processed photographic elements were handled in room light without fixing. No substantial increase in background density was observed, and, in most instances, no increase in background densities were visibly detectible.

Cobalt(III)Complexes

EXAMPLES 127 THROUGH 136

An image-recording element was in each instance formed by adding a solution of 30 mg of dye, identified below in Table XVI, in 0.50 grams of dimethylformamide to 5.0 grams of a 10 percent by weight solution of cellulose acetate butyrate in acetone. The resulting solution was coated at 43° C. on a poly(ethylene terephthalate) film support to a wet coating thickness of approximately 100 microns and dried.

A radiation-sensitive element was formed by solvent coating onto a poly(ethylene terephthalate) film support a composition 8.1 mg/dm$^2$ of 2-isopropoxy-1,4-naphthoquinone (PR-54), 6.2 mg/dm$^2$ of cobalt hexa-ammine acetate and 60.3 mg/dm$^2$ of cellulose acetate butyrate in acetone.

The radiation-sensitive element was given a 20 second imagewise exposure with an ultraviolet light source (commercially available as a Canon Kalfile Printer 340 VC). The exposed radiation-sensitive coating and the image-recording coating were placed face-to-face and passed through a pair of pressure rollers heated to 100° C. and having a linear speed of 0.66 cm/sec. After passing between the rollers, the radiation-sensitive and image-recording elements were separated and the image-recording layer viewed. The observed results are set forth below in Table XVI.

TABLE XVI

| Ex. No. | Dye | Exemplary Pyrylium Dye Containing Separate Image-Recording Elements: Un-exposed Areas | Exposed Areas |
|---|---|---|---|
| 127 | 2,6-diphenyl-4-(3-methoxyphenyl) pyrylium perchlorate | yellow | colorless |
| 128 | 4-phenyl-2,6-dithienyl pyrylium perchlorate | orange-yellow | colorless |
| 129 | 4-(4-morpholinophenyl)-2,6-diphenyl-pyrylium perchlorate | magenta | colorless |
| 130 | 2,6-bis(p-methoxyphenyl)-4-phenyl-pyrylium fluoroborate | orange | colorless |
| 131 | 2,4-diphenyl-6-(β-methyl-3,4-diethoxy-styryl)pyrylium fluoroborate | magenta | colorless |
| 132 | 4-(4-dimethylaminovinyl)2,6-diphenyl-pyrylium perchlorate | cyan | colorless |
| 133 | 2-(2-naphthyl)-4,6-diphenylpyrylium perchlorate | orange-yellow | colorless |
| 134 | 9-(4-dimethylaminobenzylidene)-2,4-diphenyl-6,7,8,9-tetrahydro-5H-cyclo-hepta[b]pyrylium perchlorate | blue | pale yellow |
| 135 | 2,6-diphenyl-4-[2(10-methylpheno-thiazinyl)]pyrylium perchlorate | green | colorless |
| 136 | 2-butyl-3-[β-(2-hydroxy-1-naphthyl)-vinyl]-naphtho[2,1-b]pyrylium per-chlorate | blue | colorless |

EXAMPLES 137 THROUGH 161

In each instance a coating composition was prepared consisting essentially of 1.0 gram of cellulose acetate butyrate; 11.3 grams ethylene dichloride; 2.0 grams methanol; 2 drops of water; 0.10 gram hexa-ammine cobalt(III)acetate and 1.00 millimole of photoreductant. Each coating composition was used to prepare two identical coatings on poly(ethylene terephthalate) film support each having a wet coating thickness of approximately 100 microns. Where it was desired to expose a coating to an additional light source an additional, identical pair of radiation-sensitive elements was prepared.

Exposure was undertaken using either a predominantly ultra-violet and blue light source or a predominantly visible light source. The ultra-violet and blue light source employed a 400-watt medium pressure mercury arc lamp. A 2-second exposure was given with this light source. This light source is commercially available under the trade name Micro Master Diazo Copier. The predominantly visible light source employed an incandescent lamp of 650 watts, and a 16-second exposure was given using this light source. This light source is commercially available under the trade name Nashua 120 Multi-Spectrum Copier. In each instance exposure was made through a 0.3 log E silver step tablet. Approximately 10 seconds after exposure the radiation-sensitive element was placed in face-to-face relationship with a diazo recording element wherein the layer over the support comprised 2,5-diethoxy-4-morpholinobenzene diazoniumborofluoride mixed with 3-hydroxy-N-(o-methoxyphenyl)-2-naphthamide and 1-(1-hydroxy-2-naphthoyl) piperidine. To produce a negative image in the diazo-recording element the face-to-face elements were passed three times between rollers heated to 100° C. at a linear rate of 0.66 cm/sec.

The speed of the radiation-sensitive elements was calculated as the quotient of 100 divided by the time in seconds required to reach neutral image density above gross fog of 0.40. For purposes of comparison those elements exhibiting speeds below 12.5 were considered to be slow; those exhibiting speeds of from 12.5 to 50 were categorized as moderately slow; those exhibiting speeds of from 50 to 100 were considered moderately fast; and those exhibiting speeds above 100 were categorized as being fast. The averaged results with each identically prepared and exposed pair of radiation-sensitive elements are reported below in Table XVII. Control No. 2 utilized a photoreductant which requires an external hydrogen source, by way of comparison.

TABLE XVII

| Ex. No. | Photo-reductant | Exemplary Photoresponse with Varied Photoreductants: Speed: Near UV | Speed: Visible | Neutral Minimum Density | Notes |
|---|---|---|---|---|---|
| 137 | PR-4 | Mod. Slow | N.A. | 0.07 | — |
| 138 | PR-5 | Mod. Slow | N.A. | 0.09 | (1) |
| 139 | PR-5 | N.A. | Slow | 0.09 | — |
| 140 | PR-6 | Mod. Slow | N.A. | 0.15 | — |
| 141 | PR-6 | N.A. | Slow | 0.15 | — |
| 142 | PR-7 | Mod. Slow | N.A. | 0.08 | (1) |
| 143 | PR-8 | Fast | N.A. | 0.08 | — |
| 144 | PR-11 | Fast | N.A. | 0.08 | — |
| 145 | PR-12 | Fast | N.A. | 0.08 | — |
| 146 | PR-13 | Fast | N.A. | 0.09 | — |
| 147 | PR-17 | Mod. Fast | N.A. | 0.08 | — |
| 148 | PR-22 | Mod. Slow | N.A. | 0.15 | (1) |
| 149 | PR-23 | Mod. Slow | N.A. | 0.20 | — |
| 150 | PR-24 | Mod. Slow | N.A. | N.R. | (1) |
| 151 | PR-26 | Mod. Slow | N.A. | 0.09 | — |
| 152 | PR-27 | Mod. Slow | N.A. | 0.10 | — |
| 153 | PR-28 | Mod. Slow | N.A. | 0.10 | — |
| 154 | PR-30 | Mod. Slow | N.A. | 0.08 | — |
| 155 | PR-31 | Mod. Slow | N.A. | 0.09 | — |
| 156 | PR-32 | Mod. Slow | N.A. | 0.09 | — |
| 157 | PR-36 | Mod. Fast | N.A. | 0.07 | — |
| 158 | PR-39 | Fast | N.A. | 0.08 | — |
| 159 | PR-40 | Fast | N.A. | 0.07 | — |
| 160 | PR-41 | Mod. Slow | N.A. | 0.08. | — |
| 161 | PR-42 | Mod. Fast | N.A. | 0.06 | (2) |
| Control No. 1 | None | No Image | N.A. | 0.06 | (3) |
| Control No. 2 | 2,5-dimethyl-1,4-benzo-quinone | Slow | N.A. | 0.08 | |

N.A. = Not Applicable (1) One pass was made through the heated rollers instead of three.

(2) Photoreductant incompletely dissolved in solvent; only decantate was used to form coatings.

(3) Procedure for preparing and evaluating control was indentical to the preceeding examples, except that no photoreductant was included in the coating composition.

EXAMPLE 162

A coating composition was prepared consisting essentially of hexa-ammine cobalt(III) trifluoroacetate, 500 mg; CH-43, 65.0 mg; PR-54, 220 mg; cellulose acetate butyrate, 1000 mg; and 10 g acetone. A coating was formed using the composition having a wet thickness of 100 microns on a poly(ethylene terephthalate) film support. After drying the coating was imagewise exposed to an ultraviolet and blue radiation source medium pressure mercury arc lamp for 0.5 second. This light source is commercially available under the trademark Micro Master Diazo Copier. The imagewise exposed coating was then heated to 100° C. for 10 seconds by passage between heated rollers. A bright red image was formed in irradiated areas having a density of 1.3.

EXAMPLE 163

A coating composition was prepared consisting essentially of tris(ethylenediamine)cobalt(III)acetate, 210.0 milligrams; 1-(2-pyridylazo)-2-naphthol, 120 milligrams; PR-54, 110.0 mg; cellulose acetate butyrate, 1000.0 mg; and 10 g acetone. The procedure of the preceding Example was repeated, except that the coating was imagewise exposed for 8 seconds. A magenta image was formed in exposed areas having a density of 1.3.

Triazolium Salts

EXAMPLES 164 THROUGH 175

In each instance a radiation-sensitive coating composition was prepared as set forth in Table XVIII incorporating one of the triazolium salts, the preparation of which is described above.

TABLE XVIII

| Radiation-Sensitive Coating Composition | |
|---|---|
| Cellulose acetate butyrate | 0.66 g. |
| 1,2-dichloroethane | 11.3 g. |
| Methanol | 1.98 g. |
| 2-isopropoxy-1,4-naphthoquinone | 1.00 millimoles |
| Triazolium Salt | 1.00 millimoles |

Each coating composition was coated at a wet thickness of 100 microns on 100 micron poly(ethylene terephthalate) film base. After the solvents had evaporated, a portion of the coating was exposed to ultraviolet light through a black and white transparency and then the coating was treated with ammonia fumes. In each case a negative of the original transparency was obtained. Table XIX lists the image colors and backgrounds obtained with the various triazolium salts.

TABLE XIX

Exemplary Photographic Elements

| Example No. | Triazolium Salt | Exposed Areas | Unexposed Areas |
|---|---|---|---|
| 164 | Tr-1 | Yellow | Colorless |
| 165 | Tr-6 | Yellow-orange | Colorless |
| 166 | Tr-8 | Orange-red | Colorless |
| 167 | Tr-17 | Red | Colorless |
| 168 | Tr-18 | Gray | Colorless |
| 169 | Tr-21 | Red | Colorless |
| 170 | Tr-25 | Reddish-violet | Colorless |
| 171 | Tr-26 | Reddish-violet | Colorless |
| 172 | Tr-28 | Violet | Colorless |
| 173 | Tr-29 | Red | Colorless |
| 174 | Tr-30 | Red | Colorless |
| 174 | Tr-31 | Red | Colorless |

Other Imaging Means

Examples 176 through 178 utilize a silver salt of an organic acid as the image recording means. In each case, the coating contained 1.0 g cellulose acetate butyrate as the binder, 0.22 g silver trifluoroacetate, 2.0 g methanol, 11.3 g 1,2-dichloroethane, and a photoreductant identified below.

| Example | Photoreductant |
|---|---|
| 176 | 0.172 g 2-methyl-1,4 naphthoquinone and 0.1 g phenyl-1,2-ethanediol (external H source only |

-continued

| Example | Photoreductant |
|---|---|
| 177 | 0.216 g 2-isopropoxy-1,4-naphthoquinone (PR-54) |
| 178 | 0.202 g 2-(2-hydroxyethyl)-1,4-naphthoquinone(PR-69) |

Each solution was coated at 75° F. with a 100 micron coating knife on a poly(ethylene terephthalate) film support containing a vinylidene chloride-acrylonitrile-acrylic acid subbing layer and dried for five minutes. The coatings were exposed for 60 sec. through a 0.15 log E step tablet on a Kalfile Printer 340VC made by Canon Camera Company Inc., and processed on a heated shoe at 145° C. for 10 sec. All three coatings gave yellow images on a clear background. Plots of image densities to blue light vs. relative log exposure showed that the coatings containing quinones with internal hydrogen atom sources (coating solutions 177 and 178) were respectively 0.37 log E and 0.82 log E faster than the coating with an external hydrogen atom source (176) at a density of 1.0 above fog.

Examples 179–193 illustrate the use of internal hydrogen source quinones with bleachable dyes as the image recording means. Examples 188–193 differ from Examples 179–187 only in that no quinones or quinones lacking the internal hydrogen sources were used in place of internal hydrogen source quinones, to illustrate the marked decrease in bleaching, and therefore in imaging, which results in the absence of the internal hydrogen sources. Although the specific examples have been formulated in terms of certain lithographic plates, the bleaching of the dyes by the photoreductant is not dependent on solvents and other chemical compounds peculiar to lithographic plates. Thus, in each example, the photoreductant and benzotriazole (a stabilizer) were added, as hereinafter noted, to the following lithographic formulation.

| | |
|---|---|
| Poly(methyl methacrylate-co-2-methacryloyloxyethyl 2-diazo-1,2-naphthoquinone-5-sulfonate-co-2-methacryloyloxy-ethyl benzoate) (Mole ratio 5:0.9:0.1) | 24.0 grams |
| Novolak resin (binder) | 12.0 grams |
| Boric acid (stabilizer) | 0.8 grams |
| Rhamnose (stabilizer) | 0.6 grams |
| Zinc salicylate (scum reducer) | 0.4 grams |
| 2-Methoxy ethanol | 134.0 ml. |
| 2-Methoxy ethyl acetate | 134.0 ml. |
| 2-Butanone | 106.0 ml. |
| 1,2-Dichloroethane | 168.0 ml. |
| 4-Butyrolactone | 16.8 ml. |

To 10 ml portions of this composition were added 5 mg of the dye and the amounts of photoreductant and benzotriazole indicated in Table XX. The resulting solutions were whirl-coated on anodized aluminum and dried. The coated samples were exposed to a carbon arc for 2 minutes with the results shown in Table XX.

TABLE XX

| Example | Dye: Common Name | Dye: Color Index | Dye: Structure | Photoreductant | Amount | Benzo-triazole | Amount | Bleach-Out Image Formed |
|---|---|---|---|---|---|---|---|---|
| 179 | thionin | 52000 | 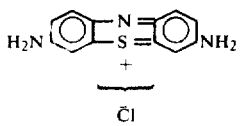 | 2-isopropoxy-1,4-naphtho-quinone (PR-54) | 10 mg | Yes | 0.6 g | good image |
| 180 | thionin | | (see 179 above) | 2-isopropoxy-1,4-naphtho-quinone (PR-54 | 20 mg | No | — | excellent image |
| 181 | thionin | | (see 179 above) | 2-(2-hydroxy-ethyl)-1,4-naphthoquinone (PR-69) | 20 mg | No | — | fair image |
| 182 | Azure A | 52005 | 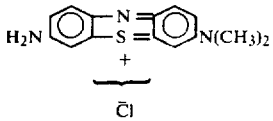 | PR-54 | 20 mg | No | — | good image |
| 183 | Azure B | 52010 | 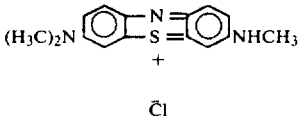 | PR-54 | 20 mg | No | — | good image |
| 184 | Azure C | 52002 | 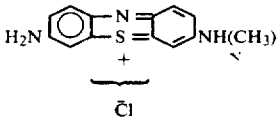 | PR-54 | 20 mg | No | — | excellent image |
| 185 | brilliant cresyl blue | 51010 | 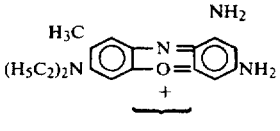 | PR-54 | 20 mg | No | — | good image |
| 186 | methylene blue | 52015 | 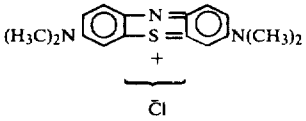 | PR-54 | 20 mg | No | — | good image |
| 187 | toluidine blue 0 | 52040 | 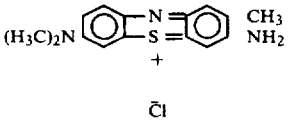 | PR-54 | 20 mg | No | — | excellent image |
| 188 | methylene blue | | (see 186 above) | 9,10-phenan-threnequinone | 10 mg | Yes | 0.6 g | no image |
| 189 | thionin | | (see 179 above) | 1,4-naphtho-quinone | 10 mg | Yes | 0.6 g | faint image |
| 190 | thionin | | (see 179 above) | 2-hydroxy-1,4-naphthoquinone | 10 mg | Yes | 0.6 g | faint image |
| 191 | thionin | | (see 179 above) | p-benzoquinone | 10 mg | Yes | 0.6 | no image |
| 192 | thionin | | (see 179 above) | 6,11-dihydroxy naphthacene-quinone | 10 mg | Yes | 0.6 | no image |
| 193 | thionin | | (see 179 above) | none | 10 mg | Yes | 0.6 | no image |

Examples 194 through 199 are illustrative of the use of the invention with leuco dyes. In each of these examples, copper leucophthalocyanine dye prepared as taught by British Pat. No. 745,359 and having the following structure, was used.

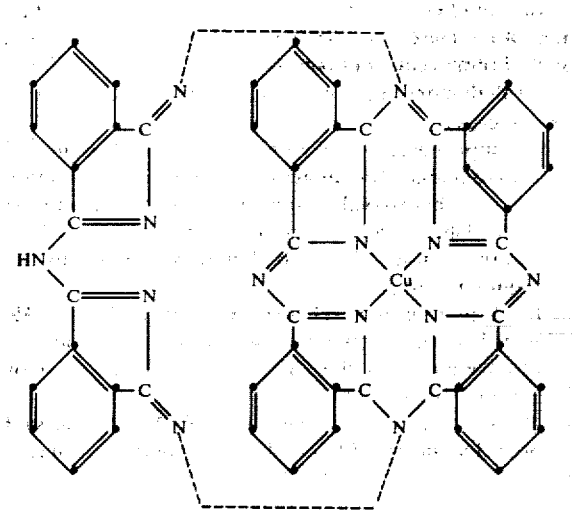

(• represents C atom and sufficient H atoms to satisfy any remaining bonds not indicated)

Dopes were prepared so as to consist of 1.0 mmole of a quinone, 0.50 g of copper leucophthalocyanine and 0.66 g of cellulose acetate butyrate in ethylene chloride/methanol (9.0 ml/2.5 ml). The dopes were coated at 100 micron wet thickness on poly(ethylene terephthalate) film support. Exposure (8 sec) and ammonia development were accomplished in the IBM processor as described in the previous examples. Four coatings, each containing a different photoreductant, were prepared and processed with the following results:

Example 194 contained 2-methylnaphthoquinone, which lacks internal hydrogens, and phenyl-1,2-ethanediol as an external hydrogen supplying material. A negative blue image on a near colorless background was produced.

Example 195 contained 2-methylnaphthoquinone with no hydrogen source other than the binder. An image as in Example 194 was obtained but required four times the exposure given 194.

In Example 196, the 2-methylnaphthoquinone was replaced by 2-(2'-hydroxyethyl)-1,4-naphthoquinone (PR-69) and was otherwise the same as Example 195. An image as with 194 was obtained but was produced with less than ¼ of the exposure given Example 194.

Example 197 contained 2-isopropoxy-1,4-naphthoquinone (PR-54) in lieu of 2 methylnaphthoquinone. Again, an image as with Example 194 was obtained but with less than ¼ of its exposure.

Examples 198 and 199 consisted of a repeat of Examples 196 and 197 except that they were heat developed at 150° C. for three seconds, rather than ammonia developed. Equivalent images were formed, but required less than 1/10 the exposure given to Examples 194 when it was similarly heat processed.

Although the invention has been described in connection with certain preferred embodiments, it is not intended that it be limited thereto. Rather, it is intended that the invention cover all alternate arrangements as may be included within the scope of the following claims.

We claim:

1. In a photographic element comprising a support, a photoreductant, and in chemical association with the photoreductant, a tetrazolium salt capable of reduction by the exposed form of said photoreductant to a formazan dye, said salt and said photoreductant being disposed in at least one layer on said support in amounts effective to photogenerate an image, the improvement in which said photoreductant incorporates one or more labile hydrogen atoms capable of causing said photoreductant to reduce said salt on exposure to activating radiation in the presence of a base.

2. An element as defined in claim 1, the further improvement in which said tetrazolium salt contains in the 2 and 3 tetrazole ring positions, substituents chosen from the class consisting of aryl, pyridyl, quinolyl and azolyl substituents.

3. An element according to claim 1, wherein said salt is a 2,3-diaryl-2H-tetrazolium salt.

4. An element according to claim 1, the further improvement in which said tetrazolium salt is a triaryl-2H-tetrazolium salt.

5. An element according to claim 1, the further improvement in which said tetrazolium salt is a 2,3,5-triphenyl-2H-tetrazolium salt.

6. An element according to claim 1, the further improvement in which said tetrazolium salt is a tetrafluoroborate or a hexafluorophosphate.

7. An element as defined in claim 1, wherein said composition includes a chelating composition capable of interacting with a formazan dye to form a chelate.

8. An element according to claim 7, the further improvement in which said chelating composition is chosen from the class consisting of copper, zinc, mercury, cadmium, cobalt and nickel salts.

9. An element according to claim 7, the further improvement in which said chelating composition is a metal carboxylate.

10. A photographic element according to claim 1, the further improvement in which said photoreductant incorporates a labile hydrogen atom attached to a carbon atom which is also bonded to the oxygen atom of any oxy substituent or the nitrogen atom of an amine substituent.

11. In a photographic element comprising a support, a tetrazolium salt capable of reduction by an exposed photoreductant to a formazan dye, and as a photoreductant in chemical association with said salt, a quinone, said salt and said photoreductant being disposed in at least one layer on said support in amounts effective to photogenerate an image, the improvement in which said quinone incorporates one or more labile hydrogen atoms capable of causing said quinone to reduce said salt on exposure to activating radiation in the ultraviolet or visible spectrum, in the presence of a base, said labile hydrogen atoms being attached to a carbon atom which is also bonded to the oxygen atom of an oxy substituent or the nitrogen atom of an amine substituent with the further provision that the carbon to hydrogen bond is the third or fourth bond removed from at least one quinone carbonyl bond.

12. A photographic element according to claim 11, the further improvement in which said quinone is a 1,4-benzoquinone or 1,4-naphthoquinone and incorporates as 2 or 3 position substituents at least one substituent chosen from the class consisting of 1' or 2'-hydroxyalkyl, hydroxyalkoxy, alkoxy, 1' or 2'-alkoxyalkyl, aralkoxy, 1' or 2'-acyloxyalkyl, 1' or 2'-aryloxyalkyl, aryloxyalkoxy, 1' or 2'-aminoalkyl, 1' or 2'-aroyloxyalkyl, alkylarylamino, dialkylamino, N,N-bis(1-cyanoalkyl- )amino, N-aryl-N-( 1-cyanoalkyl)amino, N-alkyl-N-(1-cyanoalkyl)amino, N,N-bis(1-carbalkoxyalkyl)amino, N-aryl-N-(1-carbalkoxyalkyl)amino, N-alkyl-N-(1-carbalkoxyalkyl)amino, N,N-bis(1-nitroalkyl)amino, N-alkyl-N-(1-nitroalkyl)amino, N-aryl-N-(1-nitroalkyl-)amino, N,N-bis(1-acylalkyl)amino, N-alkyl-N-(1-acylalkyl)amino, N-aryl-N-(1-acylalkyl)amino, pyrrolino, pyrrolidino, piperidino and morpholino substituents.

13. A photographic element according to claim 12, the further improvement in which said 2 or 3 position substituents incorporate alkyl moieties of 6 or fewer carbon atoms and aryl moieties which are phenyl moieties.

14. A photographic element according to claim 14, the further improvement in which said quinone is a 1,4-benzoquinone.

15. In a photographic element comprising a support, a tetrazolium salt capable of reduction by an exposed photoreductant to a formazan dye, and a photoreductant in chemical association with said salt, said salt and said photoreductant being disposed in at least one layer on said support in amounts effective to photogenerate an image, the improvement in which said photoreductant is a 1,4-quinone containing at least one 2 or 3 position 1' or 2'-hydroxyalkyl substituent containing at least one labile hydrogen atom on the alpha or beta carbon atom of the alkyl moiety bonded to the quinone ring.

16. A photographic element according to claim 15, the further improvement in which said quinone is a 1,4-benzoquinone and said substituent contains 6 or fewer aliphatic carbon atoms.

17. An element as defined in claim 1, wherein said photoreductant is a 5,8-dihydro-1,4-naphthoquinone.

* * * * *